US006123035A

United States Patent [19]

Pfister

[11] Patent Number: 6,123,035

[45] Date of Patent: Sep. 26, 2000

[54] SHELF ASSEMBLY SYSTEM

[76] Inventor: Joel W. Pfister, 4967 Kensington Gate, Shorewood, Minn. 55331

[21] Appl. No.: 09/266,554

[22] Filed: Mar. 11, 1999

Related U.S. Application Data

[63] Continuation-in-part of application No. 08/869,566, Jun. 5, 1997, Pat. No. 5,881,653.

[51] Int. Cl.[7] ..... A47B 47/00

[52] U.S. Cl. ..... 108/180; 108/91; 108/147.13; 211/188; 403/292; 403/309

[58] Field of Search ..... 108/180, 91, 147.13, 108/147.14, 192, 106, 193; 211/187, 188, 126.2, 133.1; 403/292, 297, 309, 300

[56] References Cited

U.S. PATENT DOCUMENTS

| | | | |
|---|---|---|---|
| 2,315,608 | 4/1943 | Fergusson | 108/91 |
| 2,944,780 | 7/1960 | Monk | 211/188 X |
| 3,327,656 | 6/1967 | Schwartz | 108/91 |
| 3,674,229 | 7/1972 | Keeler, II | 211/188 X |
| 4,138,953 | 2/1979 | Tashman | 108/147.13 |
| 4,640,572 | 2/1987 | Conlon | 403/297 X |
| 4,836,393 | 6/1989 | Maye | 108/91 X |
| 4,852,501 | 8/1989 | Olson et al. | 108/147.13 X |
| 4,989,519 | 2/1991 | Welsch et al. | 108/192 |
| 4,998,023 | 3/1991 | Kitts | 211/188 X |
| 5,127,342 | 7/1992 | Taylor | 108/147.13 |
| 5,144,780 | 9/1992 | Gieling et al. | 403/292 X |
| 5,218,914 | 6/1993 | Dickinson | 108/192 X |

FOREIGN PATENT DOCUMENTS

| | | | |
|---|---|---|---|
| 1129377 | 8/1982 | Canada | 108/192 |
| 0336915 | 10/1989 | European Pat. Off. | 403/297 |
| 34508 | 3/1922 | Norway | 403/292 |

*Primary Examiner*—Peter M. Cuomo
*Assistant Examiner*—Hanh V. Tran
*Attorney, Agent, or Firm*—Hugh D. Jaeger

[57] ABSTRACT

Shelf assembly system for the rapid assembly of planar shelf boards, desks, tables, audio racks and the like, having opposing interchangeable connector assemblies located at the ends of a leg where each connector assembly frictionally engages a bore in a planar shelf board or other flat horizontal surfaces. The interchangeable connector assemblies include tapered and split male and female connectors which mutually engage and compress inwardly toward each other and outwardly against the planar shelf board bore to secure the leg to each planar shelf board. In a variation, a shelf assembly system is constructed of planar shelf boards and tubular legs having tapered ends connected together with one-piece flexible flanged connectors each composed of right and left mirror-image structures joined by living hinges.

23 Claims, 29 Drawing Sheets

SHELF ASSEMBLY SYSTEM

CROSS REFERENCES TO CO-PENDING APPLICATIONS

This patent application is a continuation-in-part of Serial No. 08/869,566 entitled "SHELF ASSEMBLY SYSTEM" filed on Jun. 5, 1997, now U.S. Pat. No. 5,881,653.

BACKGROUND OF THE INVENTION

1. Field of the Invention

The present invention is for shelving construction, and more particularly, pertains to a shelf assembly system for connection of one shelf to another shelf. The present invention can also be utilized for joining of flat horizontal surfaces which are connected by vertically aligned tubes, such as, but not limited to, desks, tables, audio racks, and the like. A plurality of common and interchangeable components are incorporated to provide for rapid setup and assembly of shelving in a simple and straightforward manner not requiring the use of tools.

2. Description of the Prior Art

Prior art devices for assembly of shelving boards have been, in general, unsimplified in design and construction, often requiring the use of hand tools for assembly and erection. The use of annular grooves and rings and other configurations called for construction of geometrically configured and difficult to manufacture components for the attachment of legs to the shelving boards. Often these assembly methods proved somewhat expensive and required specialized and complicated machining for configuring the shelf board to accommodate leg attachment members and other assembly components.

The present invention provides a shelf assembly system which is simple to use, incorporates a minimum of components members, and which is readily utilized to construct shelf members with a minimum of effort.

SUMMARY OF THE INVENTION

The present invention is a shelf assembly system incorporated for the simple and rapid erection of shelving. A plurality of connector assemblies are provided to join the upper and lower ends of a shelf leg to a lower and one or more upper shelf boards. The connector assemblies are identical in construction and the assembly components are interchangeable and can be reoriented, thereby requiring a minimum of component members. The connector assemblies oppose each other at opposite ends of the leg and are oriented in opposing and mirror-like fashion. Each connector assembly includes a male and female connector which is split to allow for flexing during assembly to conform to variations in leg diameter or variations of a mounting hole or bore in the shelf board. The split male connector includes an inner surface of constant radius which terminates at an inwardly extending annular lip which accommodates one end of a leg which seats against the inwardly extending annular lip. The outer surface of the split male connector tapers inwardly as the exterior radius decreases from the upper leg entry end of the split male connector to the lower edge having the inwardly extending annular lip. The split female connector includes a constant radius exterior surface and includes an annular lip extending outwardly from the upper edge. The interior of the split female connector includes a tapered surface decreasing in radius from the upper outwardly extending annular lip to the lower annular edge or surface. The outer surface of the split female connector is accommodated by a bore in the shelving board and is inserted into the bore until the outwardly extending annular lip engages the planar surface of the shelf board. The split female connector is inserted into and accommodated by the shelving board bore to subsequently receive the split male connector into which one end of the leg has been previously inserted. The leg and the split male connector are forced into wedge-like engagement with the split female connector residing in the shelf board bore thereby forcing mutual expansion of the split female connector and compression of the split male connector, thus forcing the compressive capture of the leg by the split male connector and the expansive capture of the split female connector in the bore, and, more generally, effecting the overall securement of the leg to the shelf board.

According to one embodiment of the present invention, there is provided a shelf assembly system having a cylindrical or rod-shaped leg and similarly constructed opposing upper and lower connector assemblies which fit and frictionally engage the upper and lower ends of the cylindrical or rod-shaped leg. The connector assemblies include a split male and a split female connector which are generally in the form of modified cylindrical shapes. The split male connector includes a tapered outer circumference, a constant radius interior, an inwardly extending annular lip at the lower junction of the constant radius interior and the tapered outer circumference, and a slit or split area extending vertically through the wall of the split male connector and through the inwardly extending annular lip. The split female connector includes a constant radius circumferential exterior, a tapered interior surface, an outwardly extending annular lip at the upper junction of the constant radius circumferential exterior and the tapered interior surface, and a slit or split area extending vertically through the wall and the outwardly extending annular lip. The diameter of the interior surface of the split male connector corresponds to the outer diameter of the leg. The split male and female connectors mutually engage each other in frictional engagement to form a connector assembly and to secure the leg in a bore in a planar shelf board.

A first alternate embodiment involves the use of a connector assembly to connect an additional planar shelf board to previously erected shelving according to the teachings of the invention.

A second alternate embodiment pertains to a shelved caddy constructed according to the teachings of the invention.

A third alternate embodiment concerns the support of wire shelving by various components of the invention.

A fourth alternate embodiment regards the support of a thick planar shelf board by various components of the invention.

A fifth alternate embodiment involves a one-piece flexible flanged connector and the use thereof in forming a shelf assembly system constructed with tubular legs having tapered ends.

One significant aspect and feature of the present invention is a shelf assembly system having a minimum of components which is readily assembled or disassembled without the use of hand tools.

Another significant aspect and feature of the present invention is a shelf assembly system having components which are easily and economically formed.

Another significant aspect and feature of the present invention is the use of split male and female connectors which mutually engage each other in wedge-like fashion to form a connector assembly which compresses about one or more ends of a tubular or rod-shaped leg member.

Another significant aspect and feature of the present invention is the use of split male and female connectors which mutually engage each other in wedge-like fashion to expand against a surrounding bore.

Another significant aspect and feature of the present invention is the use of split male and female connectors each of which includes a vertically aligned split for compression or expansion of the male or female connector, respectively.

Another significant aspect and feature of the present invention is a split male connector having an exterior tapered surface.

Another significant aspect and feature of the present invention is a split male connector having an inwardly extending annular lip against which one end of a leg seats. significant aspect and feature of the present invention is a split female connector having an interior tapered surface.

Another significant aspect and feature of the present invention is a tubular or rod-shaped leg member.

Another significant aspect and feature of the present invention is the use of anodized aluminum legs to provide a controllable, constant and uniform leg diameter.

Another significant aspect and feature of the present invention is a split female connector having an outwardly extending annular lip which seats against the planar surface of a shelf board.

Another significant aspect and feature of the present invention is a planar shelf board having bores which accept and accommodate split male, split female connectors and other connector components.

Another significant aspect and feature of the present invention is the ability to vertically stack two or more shelving boards.

Another significant aspect and feature of the present invention is a double male connector having a stabilizing flange for use in stacking of planar shelf boards.

Another significant aspect and feature of the present invention is the use of a threaded stabilizer rod assembly in alignment with tubular legs, split male and female connectors, flanged double male connectors, planar shelf boards, and other components in a shelved caddy.

Another significant aspect and feature of the present invention is the ability to support wire shelving.

Another significant aspect and feature of the present invention is the ability to support thick planar shelf boards.

Another significant aspect and feature of the present invention is a one-piece flexible flanged connector composed of right and left mirror-image structures joined by living hinges, which can be optional, which is used to erect a shelf assembly system constructed of planar shelf boards and tubular legs having tapered ends.

Having thus described significant aspects and features of several embodiments of the present invention, it is the principal object hereof to provide an easily erected and stable shelf assembly system composed of a minimum of parts.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
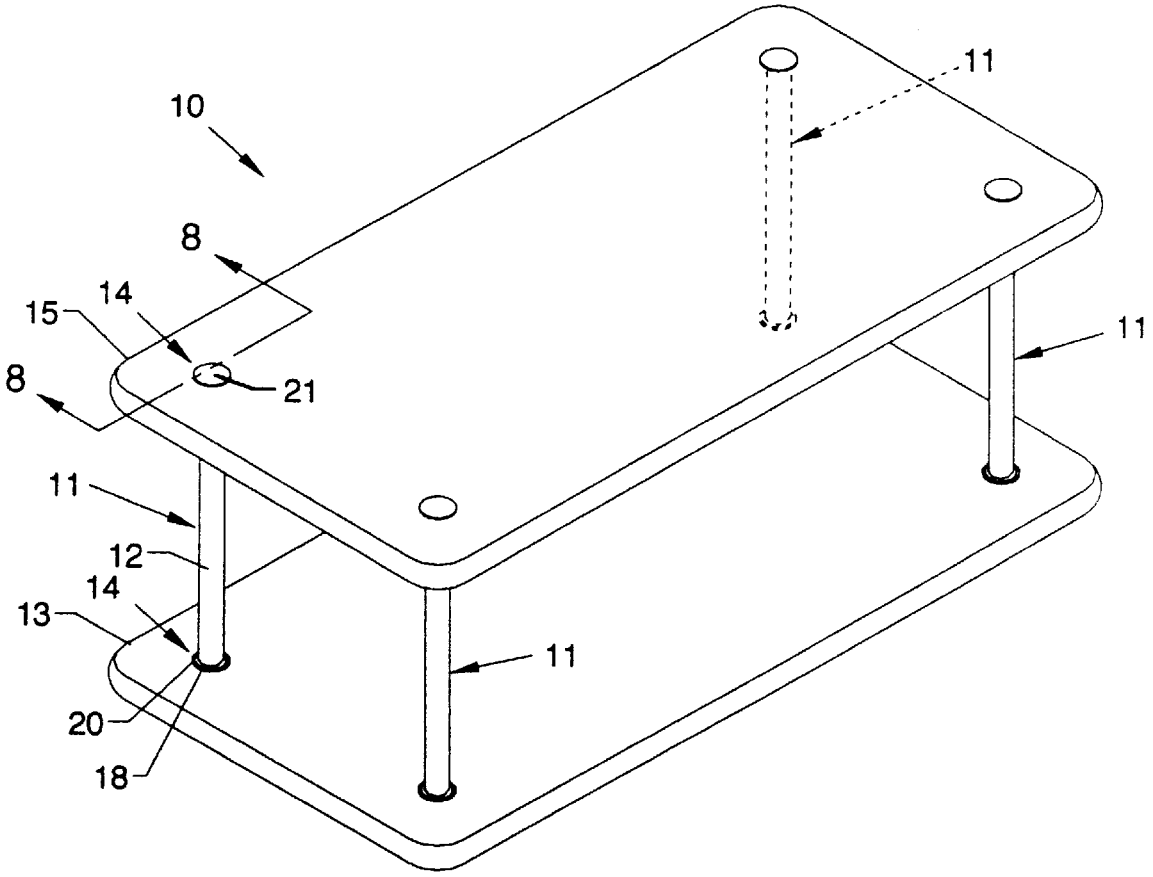
FIG. 1 illustrates an isometric view of a shelf assembly system, the present invention.

FIG. 1 illustrates an isometric view of a shelf assembly system 10, the present invention. The shelf assembly system 10 includes a lower planar shelf board 13 and an opposing and overlying planar shelf board 15 connected to each other by a plurality of like leg assemblies 11 extending vertically between the planar shelf boards 13 and 15.

Figure 2:
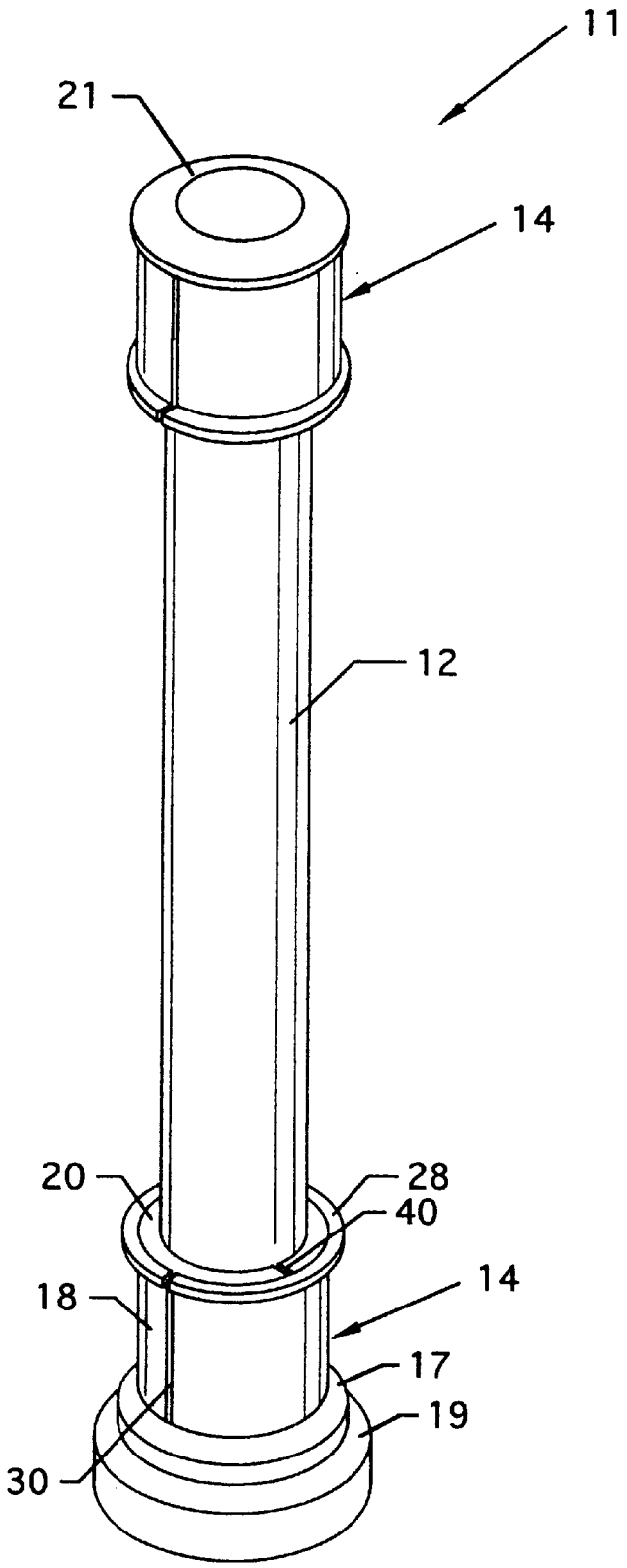
FIG. 2 illustrates an isometric view of a leg assembly.

FIG. 2 illustrates an isometric view of a leg assembly 11. The leg assembly 11 includes a centrally located cylindrical shaped leg 12 of anodized aluminum or other suitable material, a plurality of connector assemblies 14 including a connector assembly 14 aligned and frictionally engaged over and about the lower end of the leg 12, and, opposing the lower connector assembly 14 in mirror-like fashion, an upper connector assembly 14, which is interchangeable with the lower connector assembly 14, aligned and frictionally engaged over and about the upper end of the leg 12. Also included in the leg assembly 11 is a flanged tubular insert 17, a glide 19 at the lower end of the leg assembly 11 and a cap 21 at the upper end of the leg assembly 11. In the alternative, the leg 12 can be a solid rod, thereby not requiring a cap 21 and flanged tubular insert 17. Cylindrical legs throughout the invention are constructed of anodized aluminum to provide for uniform dimensional qualities, especially with regard to maintaining a suitable diameter from batch to batch. Other coatings, painting, or other treatment of the legs generally do not offer reliable dimensional control such as that offered by the use of anodized aluminum.

Figure 3:
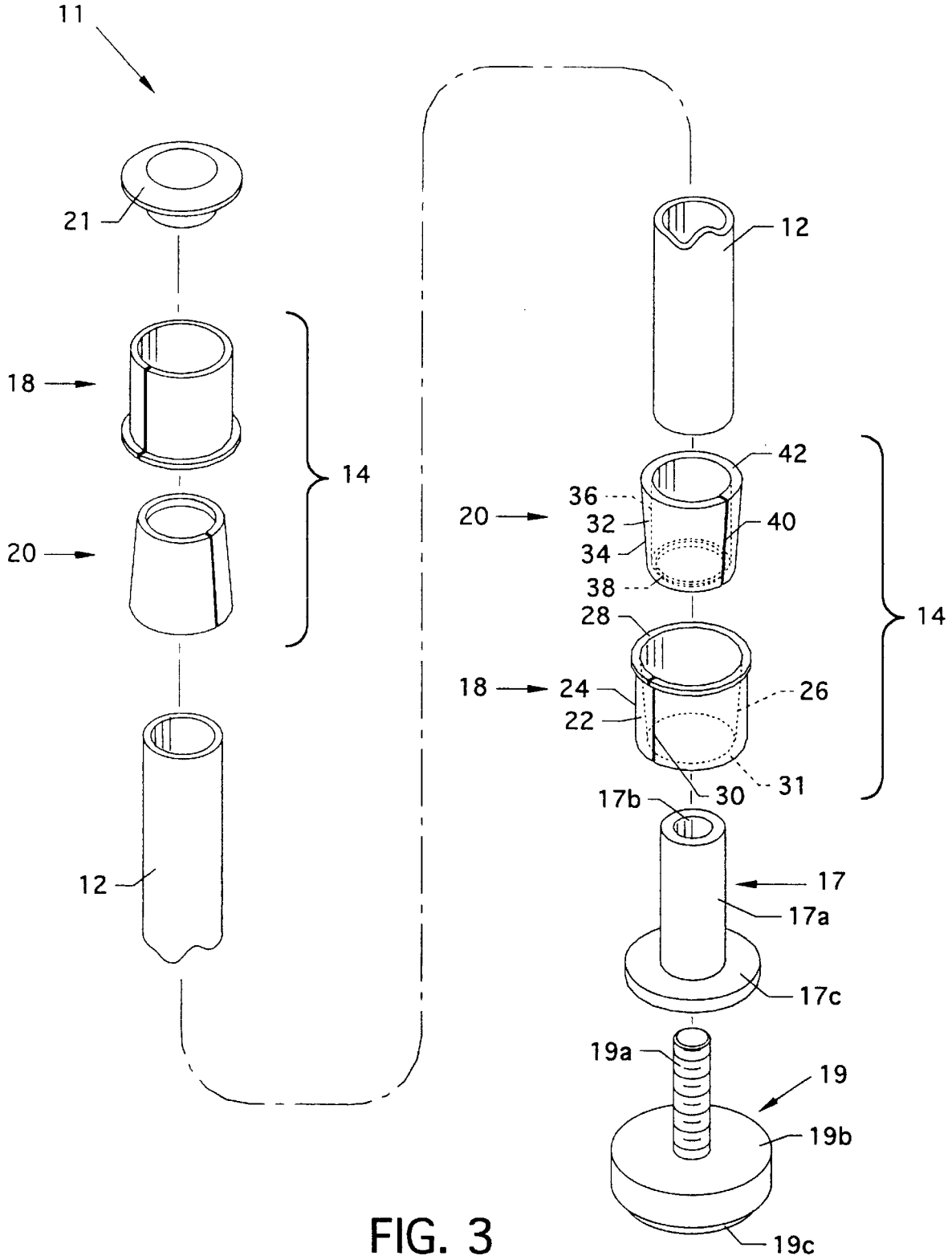
FIG. 3 illustrates an exploded view of the leg assembly.
Figure 4:
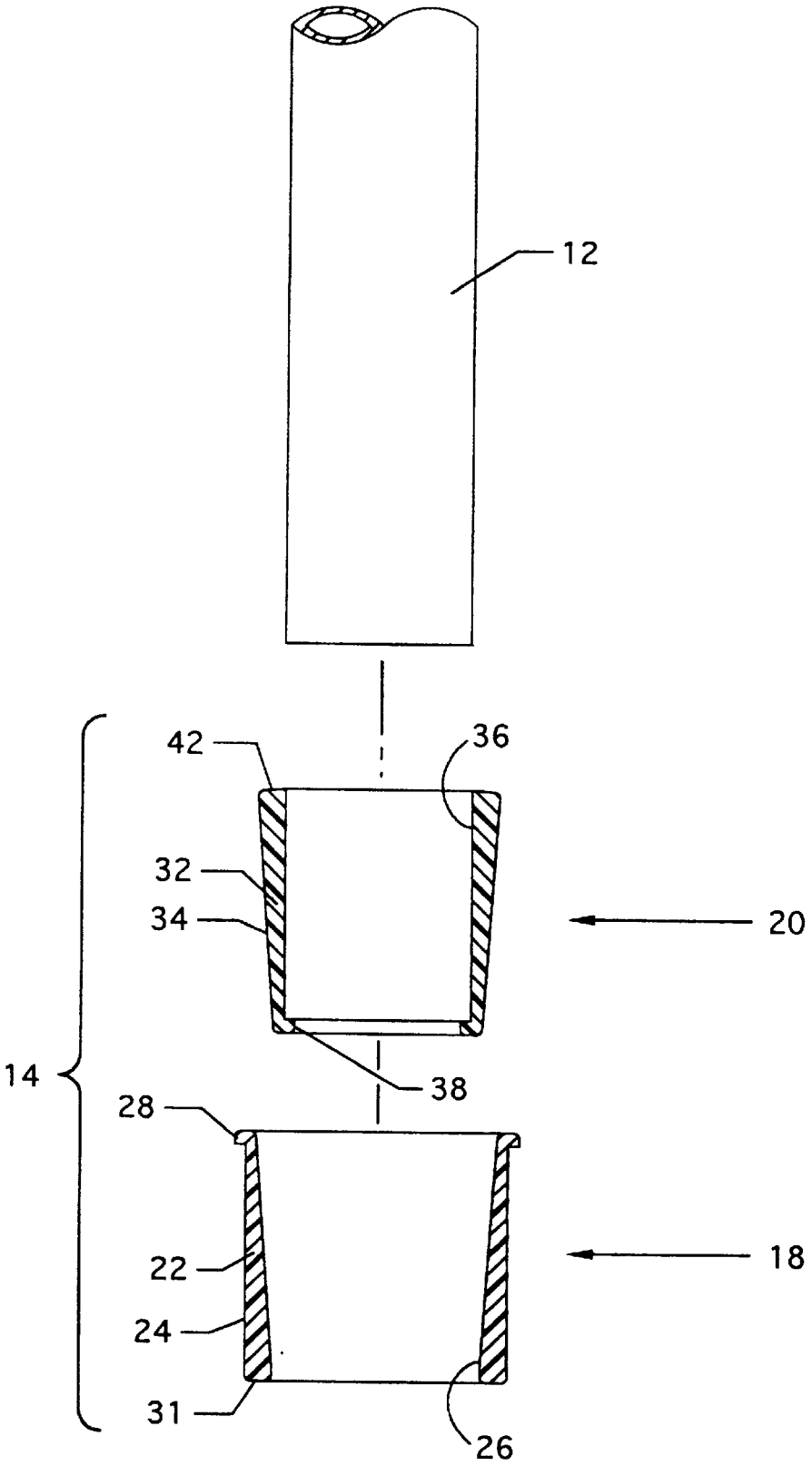
FIG. 4 illustrates an exploded cross sectional view of a leg, a split female connector, and a split male connector.

FIG. 3 illustrates an exploded view of the leg assembly 11, and FIG. 4 illustrates an exploded cross sectional view of the leg 12, a split female connector 18, and a split male connector 20, where all numerals correspond to those elements previously described. Upper connector assembly 14 and lower connector assembly 14 are constructed in a similar manner and fashion and are illustrated in opposing mirror-like fashion. With reference to FIGS. 3 and 4, the lower connector assembly 14 is now described. The lower connector assembly 14 includes a split female connector 18 and a split male connector 20, each connector including a wall having a constant radius surface, a tapered surface in the form of a truncated cone, a lip, and a slit interrupting the walls and lips. The slit female connector 18, being substantially cylindrical in shape, includes a wall 22 having an outer cylindrical surface 24 of constant radius, an opposing inner tapered surface 26, an annular lip 28 extending outwardly from the junction of the outer cylindrical surface 24 and the inner tapered surface 26 at the upper region of the wall 22, and a slit 30 interrupting the wall 22 and the annular lip 28. The radius of the taper of the inner tapered surface 26 decreases from the area adjacent to the annular lip 28 to the annular surface 31 at the lower region of the wall 22 opposing the annular lip 28. The slit male connector 20, being substantially cylindrical in shape, includes a wall 32 having an outer tapered surface 34, an opposing inner cylindrical surface 36 of constant radius, an annular lip 38 extending inwardly from the junction of the outer tapered surface 34 and the inner cylindrical surface 36 at the lower region of the wall 32, and a slit 40 interrupting the wall 32 and the annular lip 38. The radius of the taper of the outer tapered surface 34 increases from the area adjacent to the annular lip 38 to the annular surface 42 at the upper region of the wall 32 opposing the annular lip 38. The taper of the outer tapered surface 34 of the split male connector 20 corresponds to the taper of the inner tapered surface 26 of the split female connector 18. The flanged tubular insert 17 includes a cylindrical tube 17*a* with a bore 17*b*, and a flange 17*c* at one end. Glide 19 includes a shaft 19*a*, a disc 19*b*, and a plastic member 19*c* secured to the lower surface of the disc 19*b*.

Figure 5:
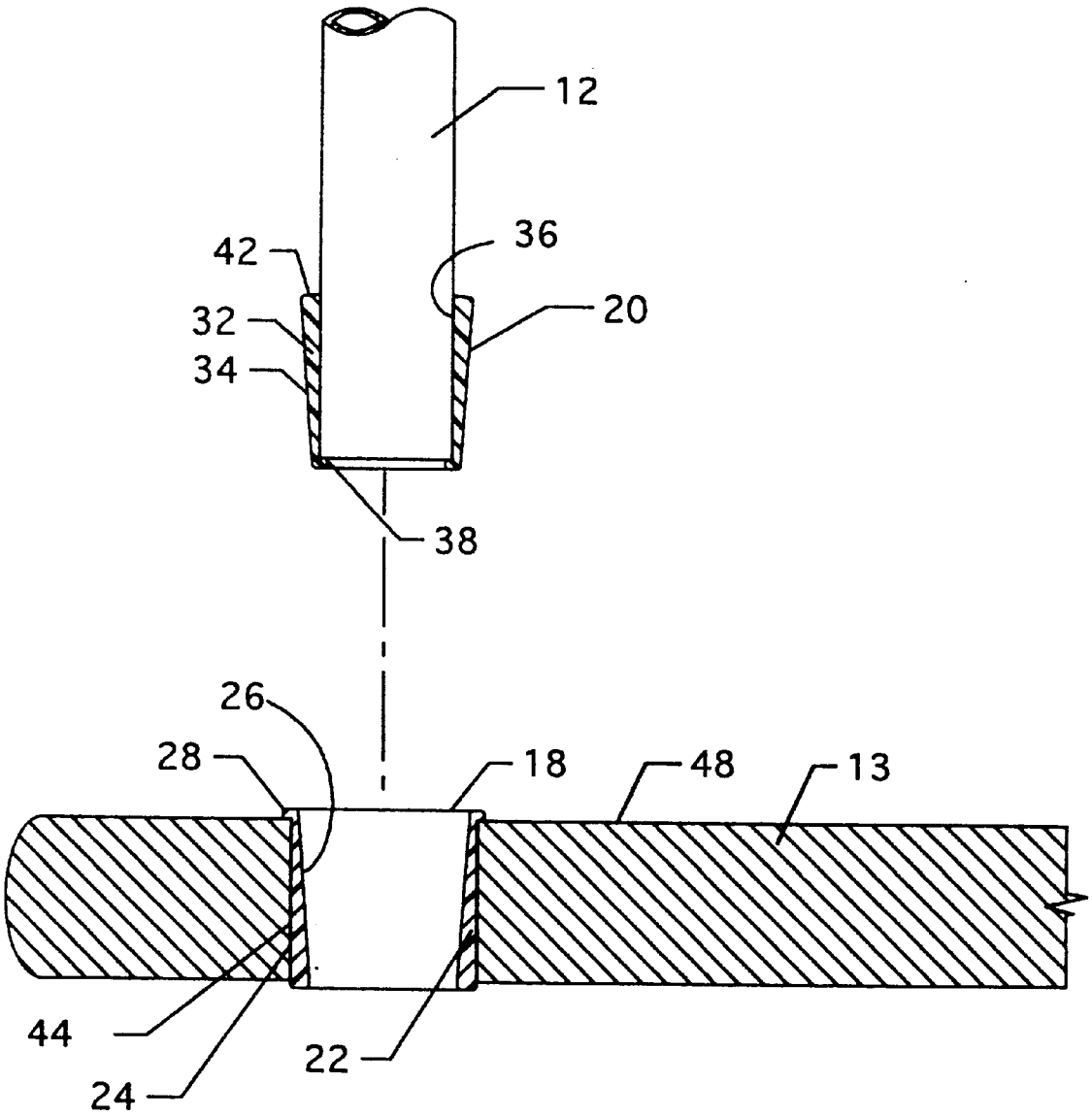
FIG. 5 illustrates a cross sectional view of a split male connector frictionally engaged over and about the lower end of a leg and a split female connector engaging a bore in a planar shelf board prior to mutual engagement.

FIG. 5 illustrates a cross sectional view of a split male connector 20 frictionally engaged over and about the lower end of a leg 12 and a split female connector 18 engaging a bore 44 in a planar shelf board 13 prior to mutual engagement, where all numerals correspond to those elements previously described. The inner cylindrical surface 36 of the split male connector 20 slidingly engages the lower end of the leg 12. The split male connector 20 is pushed over the end of the leg 12 until the inwardly extending annular lip 38 engages and seats against the end of the leg 12. The slit 40, illustrated in FIG. 3, allows for expansion or contraction of the split male connector 20 about its vertical axis to accommodate variance in the outer diameter of the leg 12 as well as various material shrinkages, expansions, or the like, of the leg 12, the split male connector 20 itself, or the split female connector 18 due to heat, cold, aging and other influences. The slit 40 also allows for inward compression of the wall 32 of the split male connector 20 against the engaged portion of the leg 12 when forceful engagement with the split female connector 18 is accomplished. The split female connector 18, which acts as a receptor for the split male connector 20 and leg 12, is inserted into a bore 44 in the planar shelf board 13 until the annular lip 28 engages and seats against the planar surface 48 of the planar shelf board 13. The slit 30, illustrated in FIG. 3, allows for expansion or contraction of the split female connector 18 about its vertical axis to accommodate variance in the diameter of the bore 44 as well as various material shrinkages, expansions, or the like, of the bore 44, the split female connector 18 itself, or the inserted split male connector 20 due to heat, cold, aging and other influences.

Figure 6:
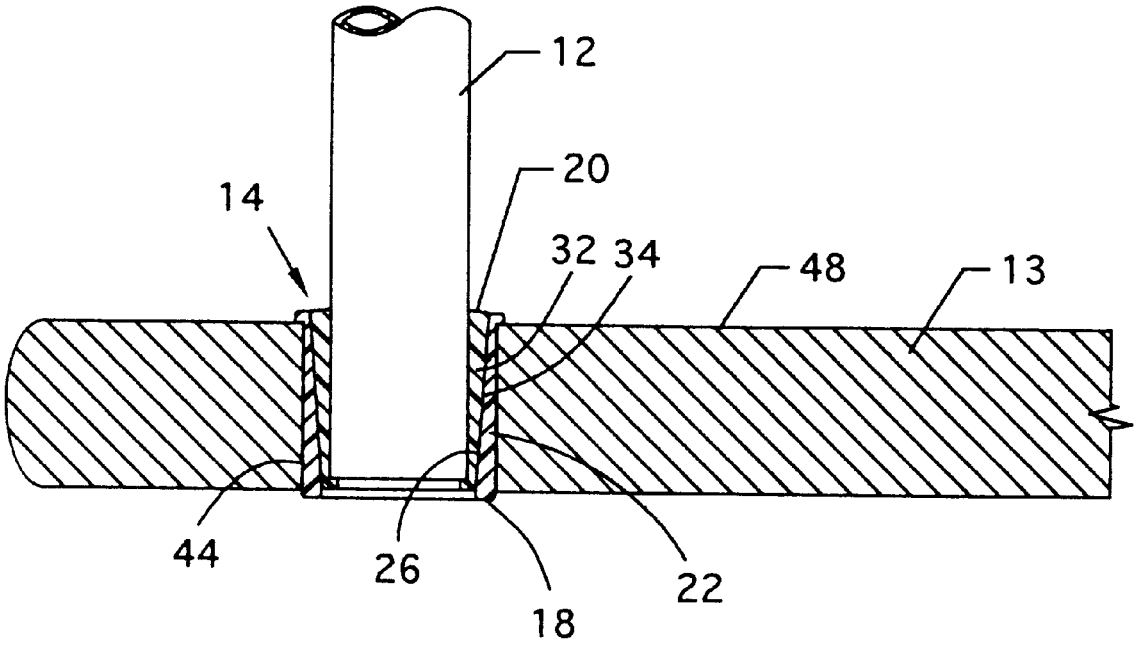
FIG. 6 illustrates a cross sectional view of a split male connector and the lower end of a leg in mutual engagement with a split female connector in a bore in a planar shelf board.

FIG. 6 illustrates a cross sectional view of a split male connector 20 and the lower end of a leg 12 in mutual engagement with a split female connector 18 in a bore 44 in a planar shelf board 13, where all numerals correspond to those elements previously described. During the forceful engagement process, the leg 12 forces the split male connector 20 into wedge-like compressional engagement with the split female connector 18. As the leg 12 and the split male connector 20 proceed into further engagement, split male connector 20 and the split female connector 18 mutually compress to provide for fixation of the leg 12, the split male connector 20, and the split female connector 18 in the bore 44 in the planar shelf board 13. This action provides for inward and outward mutual compression. As the split male connector 20 is forced in a downward direction, the wall 32 of the split male connector 20 is increasingly and inwardly compressed by reaction of the inner tapered surface 26 of the split female connector 18 against the outer tapered surface 34 of the wall 32 of the split male connector 20 to frictionally engage the leg 12. As the split male connector 20 is forced in a downward direction, the wall 22 of the split female connector 18 is increasingly and outwardly compressed by action of the outer tapered surface 34 of the split male connector 20 against the inner tapered surface 26 of the wall 22 of the split female connector 18 to frictionally engage the bore 44 in the planar shelf board 13. Respectively, inward and outward expansion of the split male connector 20 and of the split female connector 18 are accommodated and enhanced by the vertically oriented slits 40 and 30 in the walls 32 and 22 during compression.

Figure 7:
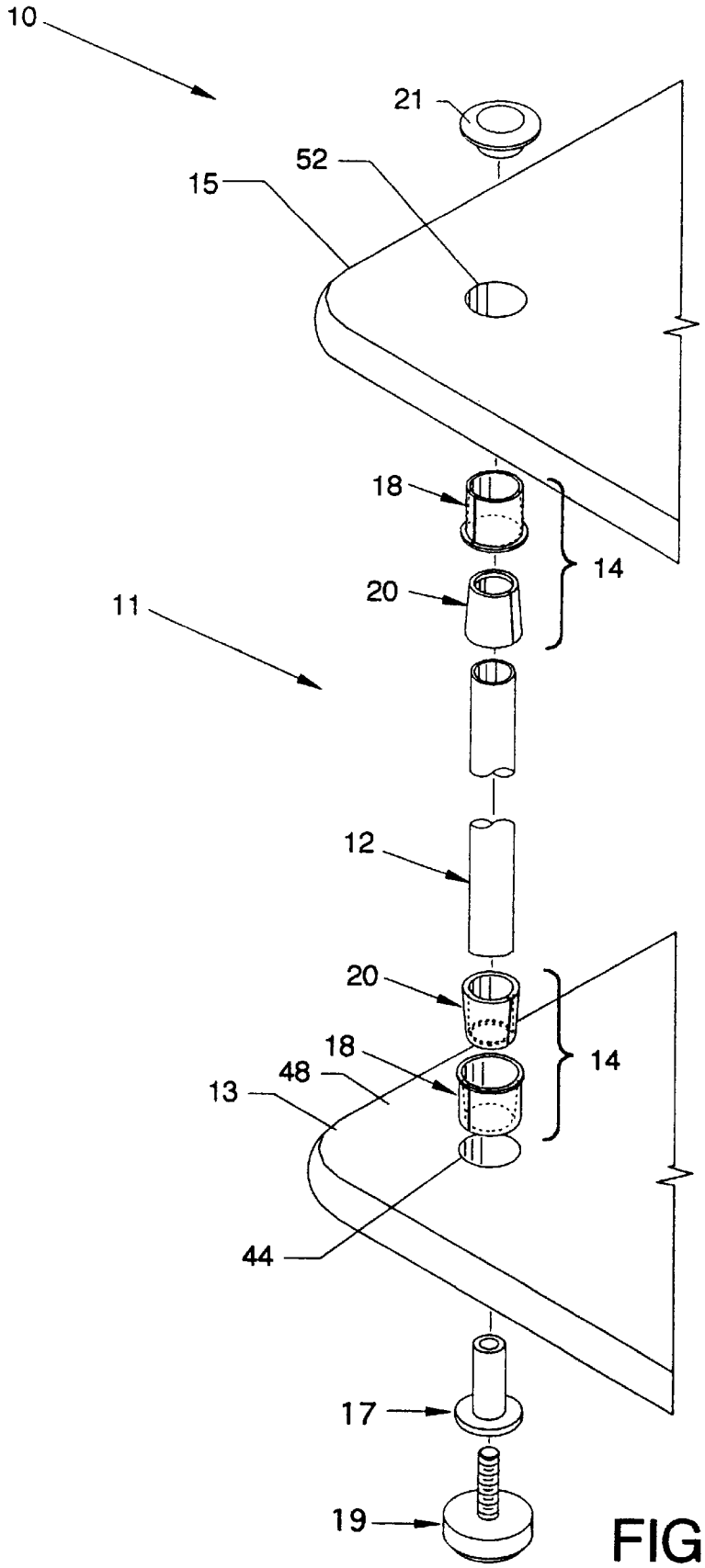
FIG. 7 illustrates an exploded view of a shelf assembly system.

FIG. 7 illustrates the use of the present invention to secure a planar shelf board 13 to a planar shelf board 15 aligned above the planar shelf board 13, where all numerals correspond to those elements previously described. A plurality of leg assemblies 11 extend vertically between the planar shelf board 13 located in the lower region of the shelf assembly system 10 and the planar shelf board 15 located in the upper region of the shelf assembly system 10 to form supported and elevated shelving. Although four leg assemblies 11 are illustrated in FIG. 1, additional leg assemblies 11 can be incorporated depending on the span of the planar shelf boards 13 and 15.

Figure 8:
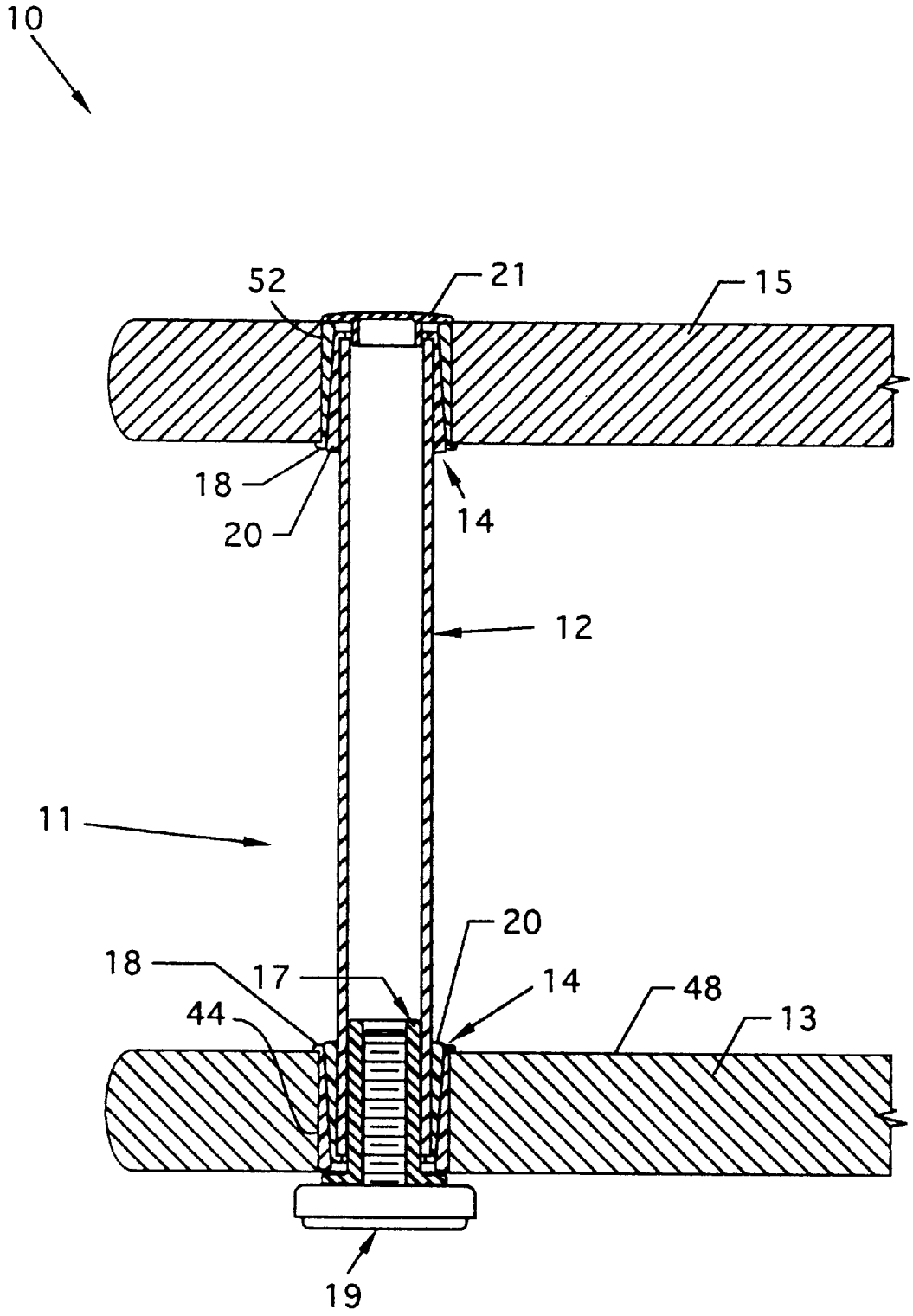
FIG. 8 illustrates a cross sectional view of a shelf assembly system along line 8—8 of FIG. 1.

FIG. 8 illustrates a cross sectional view of a shelf assembly system 10 along line 8—8 of FIG. 1. Leg assembly 11 aligns between bore 44 in the planar shelf board 13 and bore 52 in the planar shelf board 15, where all numerals correspond to those elements previously described.

Figure 9:
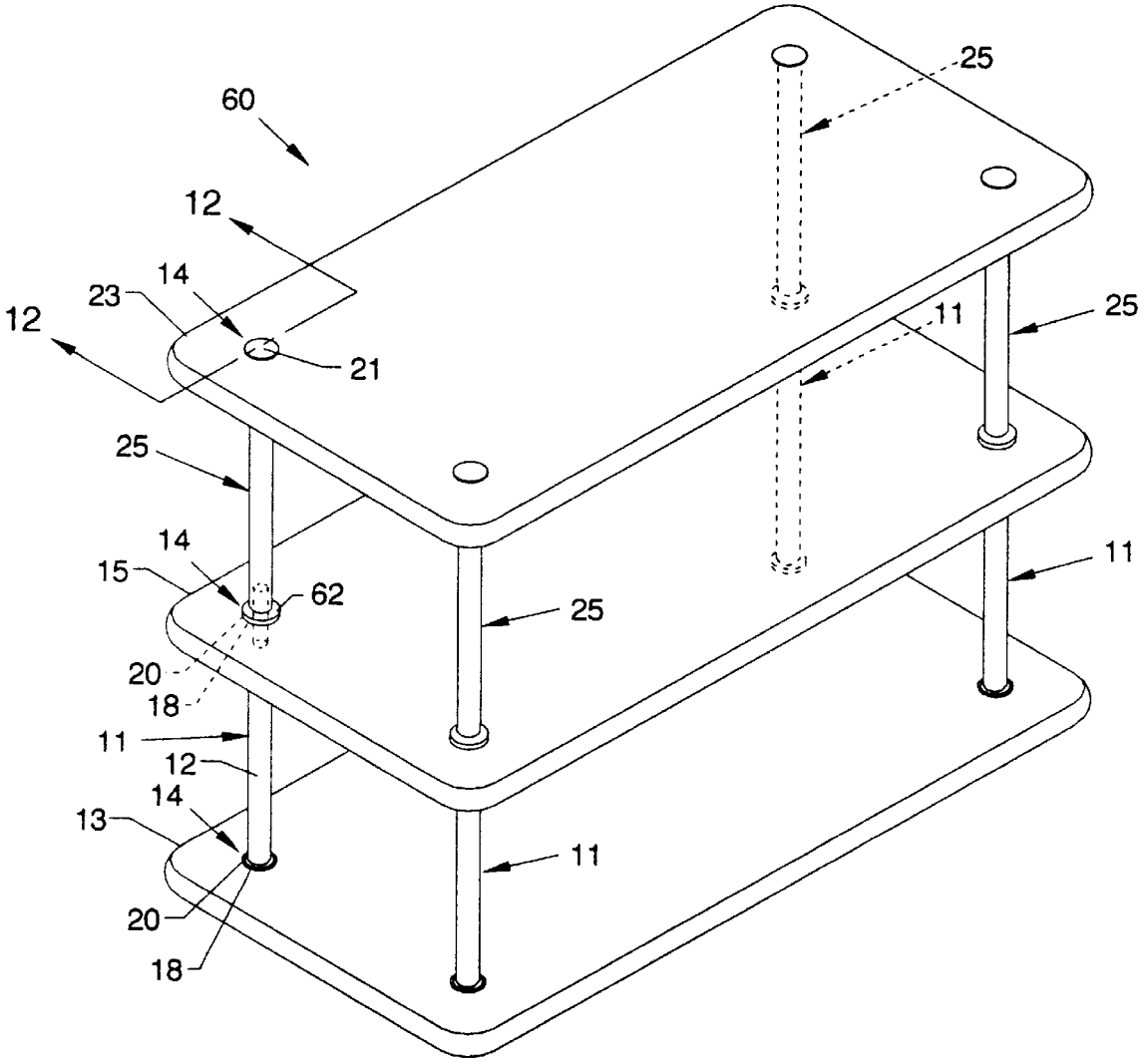
FIG. 9, a first alternate embodiment, illustrates an isometric view of a multilevel shelf assembly system connecting a lower planar shelf board to a mid-planar shelf board and the mid-planar shelf board to an upper planar shelf board.

FIG. 9, a first alternate embodiment, illustrates a shelf assembly system 60 incorporating the members of shelf assembly system 10 and additional members to provide for support of one or more additional planar shelf boards aligned over and above the planar shelf board 13, where all numerals correspond to those elements previously described. A plurality of like and similarly constructed leg assemblies 25 outwardly resembling and incorporating many of the components of leg assemblies 11 are incorporated to connect between the planar shelf board 15 and another planar shelf board 23 aligned above the planar shelf board 15. One-piece molded plastic flanged double male connectors 62, illustrated in FIG. 10, and being part of leg assemblies 25, are inserted into the tops of the leg assemblies 11, which terminate in the planar shelf board 15, to provide support for the leg assemblies 25. Conceivably, more leg assemblies 25 and planar shelf boards can be used to add additional levels of shelving.

Figure 10:
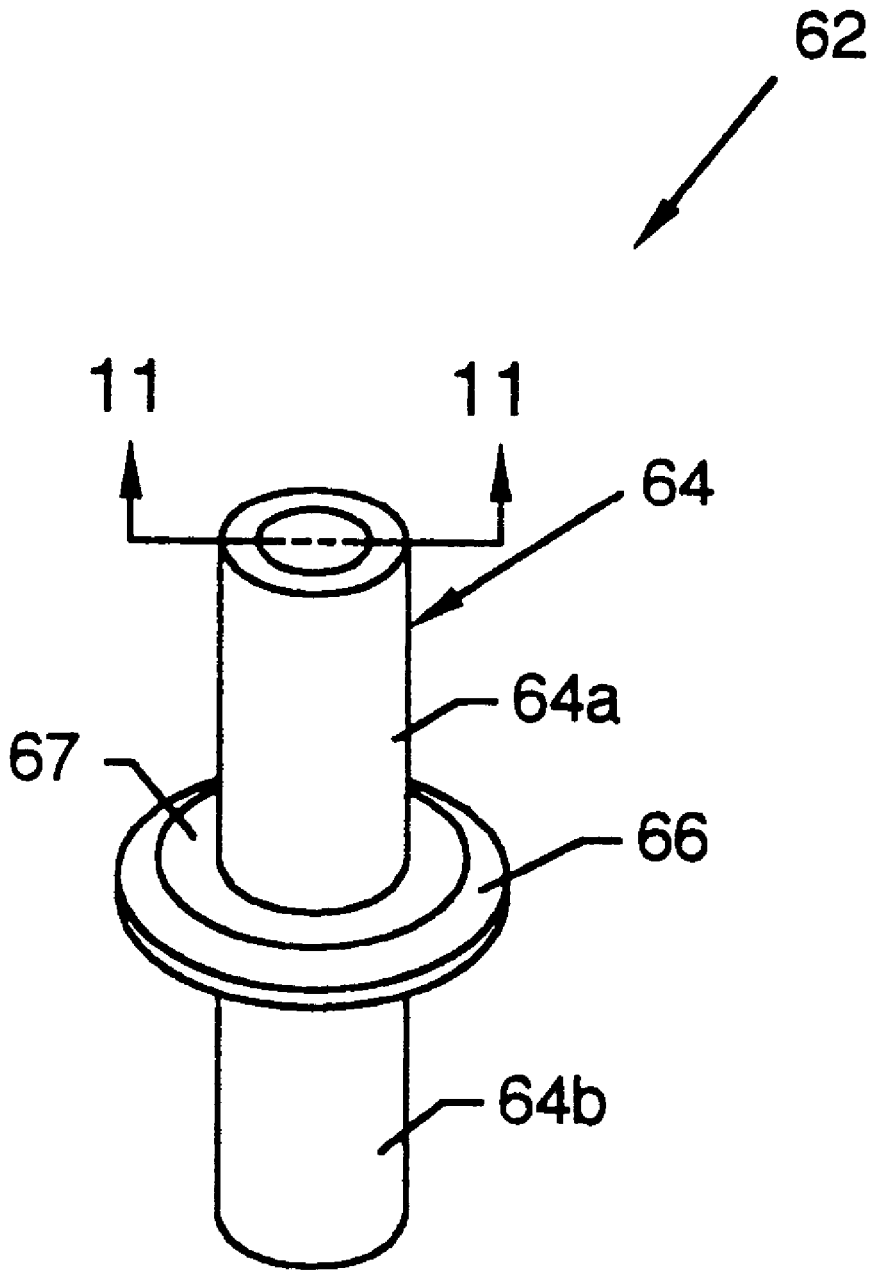
FIG. 10 illustrates an isometric view of a flanged double male connector.

FIG. 10 illustrates an isometric view of the flanged double male connector 62. The one-piece molded plastic flanged double male connector 62 includes a centrally located vertically aligned cylindrical member 64 and a flange 66 extending in annular fashion from the mid-section of the cylindrical member 64 essentially dividing the cylindrical member 64 into an upper cylindrical portion 64*a* and a lower cylindrical portion 64*b*. A planar surface 67 is located on the upper region of the flange 66 surrounding the cylindrical member 64. The flange is further illustrated in FIG. 11.

Figure 11:
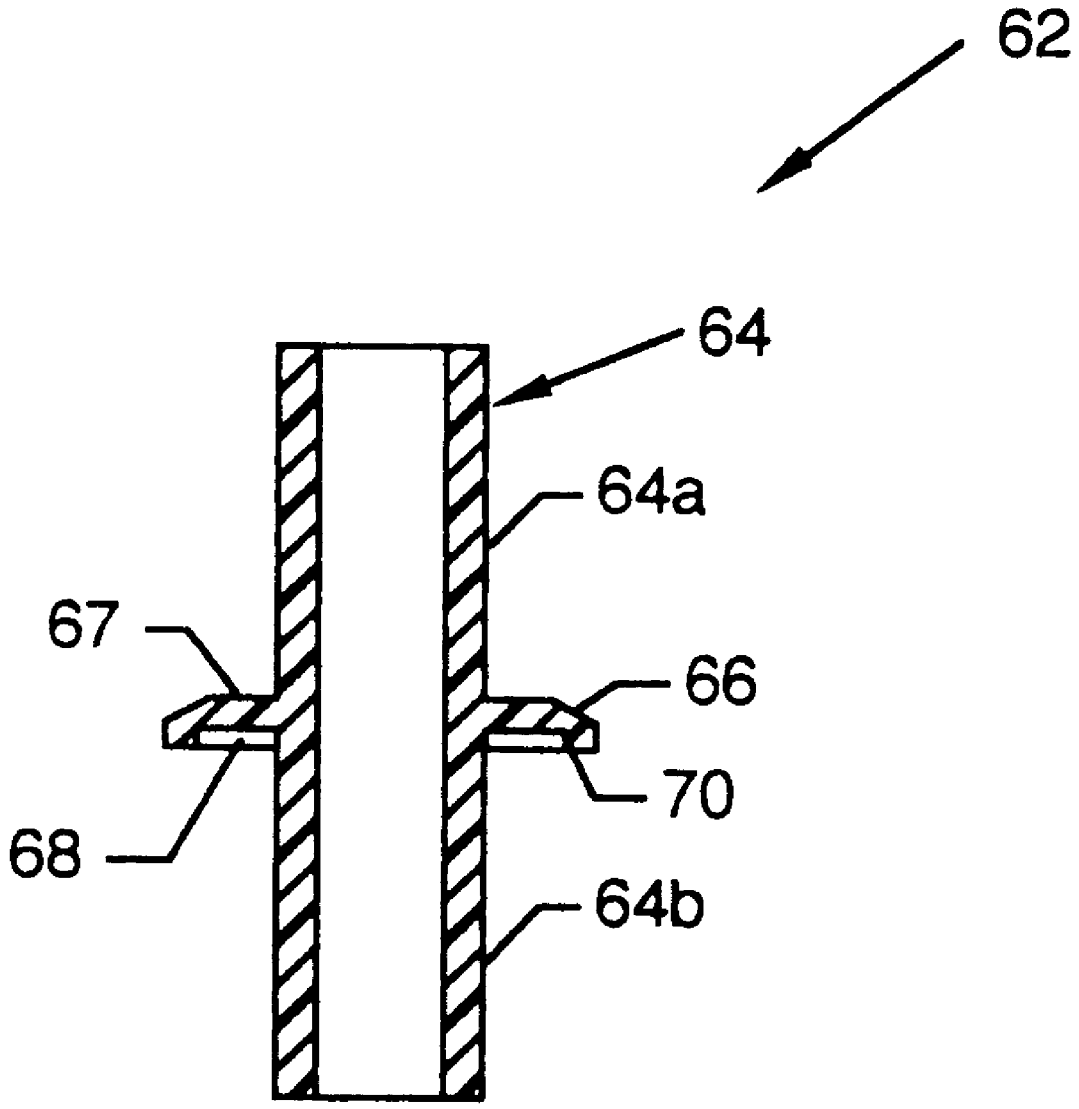
FIG. 11 illustrates a cross sectional view of the flanged double male connector along line 11—11 of FIG. 10.

FIG. 11 illustrates a cross sectional view of the flanged double male connector 62 along line 11—11 of FIG. 10, where all numerals correspond to those elements previously described. The flange 66 includes a recess 68 which accommodates, if necessary, any portion of the upper connector assembly 14 which may, but which does not necessarily, extend beyond the upper planar surface of a shelf board such as planar surface 69 of FIG. 12. Also included at the outer circumference of the flange 66 is an annular surface 70.

Figure 12:
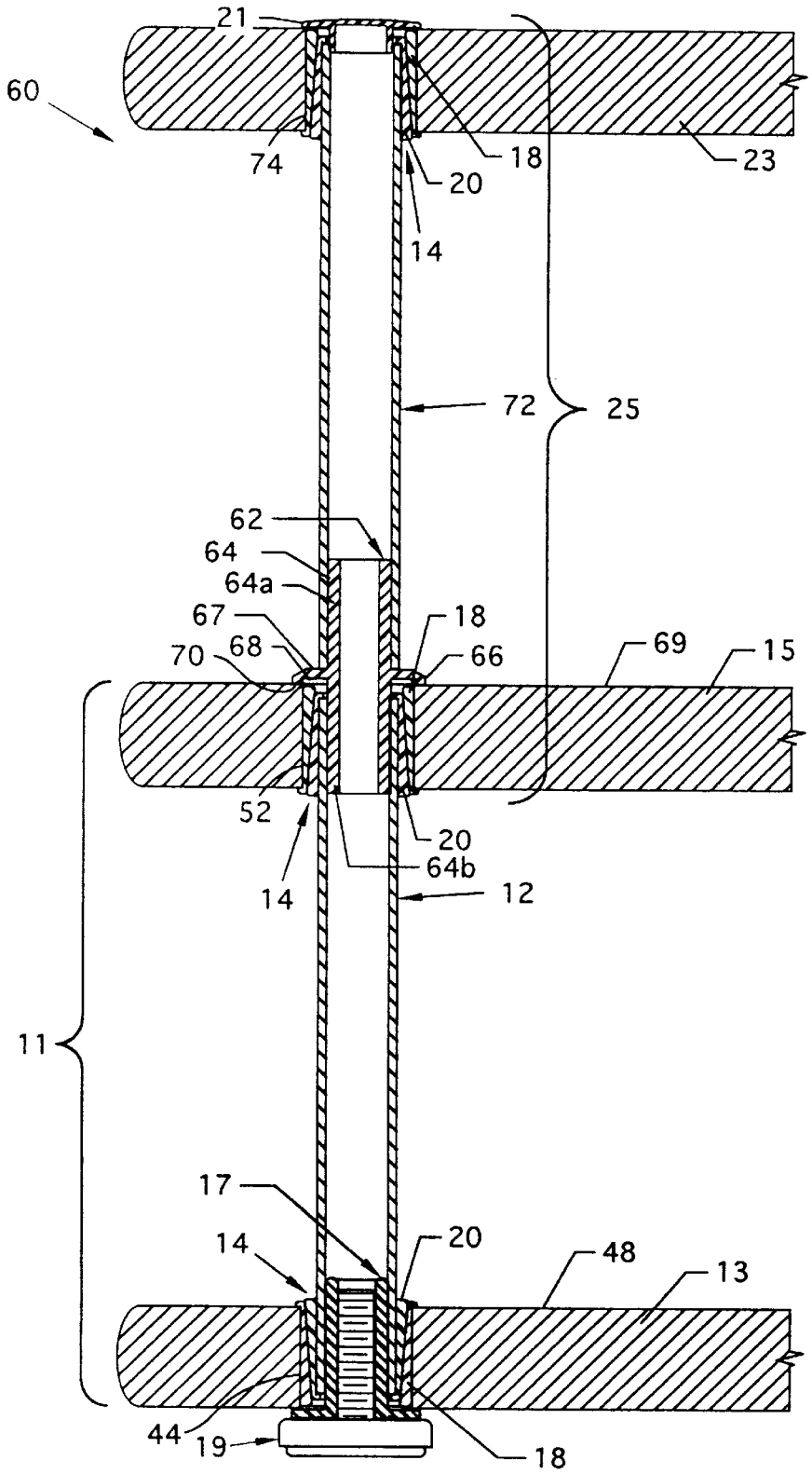
FIG. 12 illustrates a cross sectional view of the elements of FIG. 9 along line 12—12 of FIG. 9.

FIG. 12 illustrates a cross sectional view of the shelf assembly system 60 along line 12—12 of FIG. 9, where all numerals correspond to those elements previously described. Leg assembly 25 includes a flanged double male connector 62, a leg 72, an upper connector assembly 14 comprised of a split female connector 18 and a split male connector 20, and a cap 21. The outer diameters of upper and lower cylindrical portions 64*a* and 64*b* of the cylindrical member 64 form a close tolerance fit in frictional engagement with the inner diameters of upper leg 72 and lower leg 12, respectively. This close tolerance fit and the alignment of annular surface 70 of the flange 66 to the planar surface 69 on the planar shelf board 15 provides for stability of the flanged double male connector 62 and the entire leg assembly 25, as well as the planar shelf board 23. As previously noted, it can be seen that the annular recess 68 will allow for sizing differentials or extensions of the lower connector assembly 14 above the planar surface 69. The lower end of the leg 72, in frictional engagement with the upper cylindrical portion 64*a* of the cylindrical member 64, aligns to the planar surface 67 of the flange 66 for further stabilization of the leg 72. The upper end of the leg 72 connects to a bore 74 in the planar shelf board 23 by use of another upper connector assembly 14, as previously described.

Figure 13:
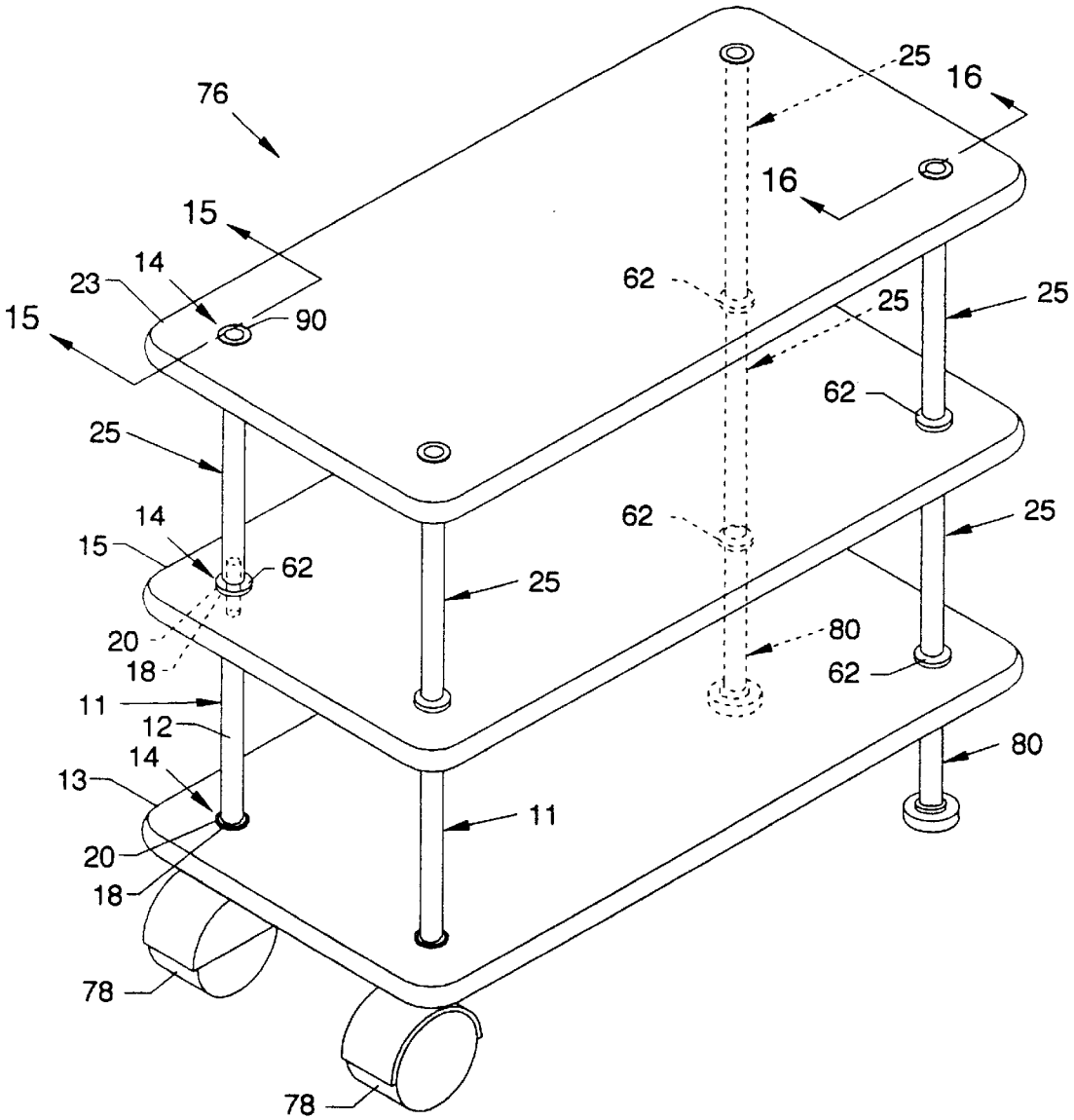
FIG. 13, a second alternate embodiment, illustrates a shelved caddy constructed according to the teachings and principles of the present invention.
Figure 14:
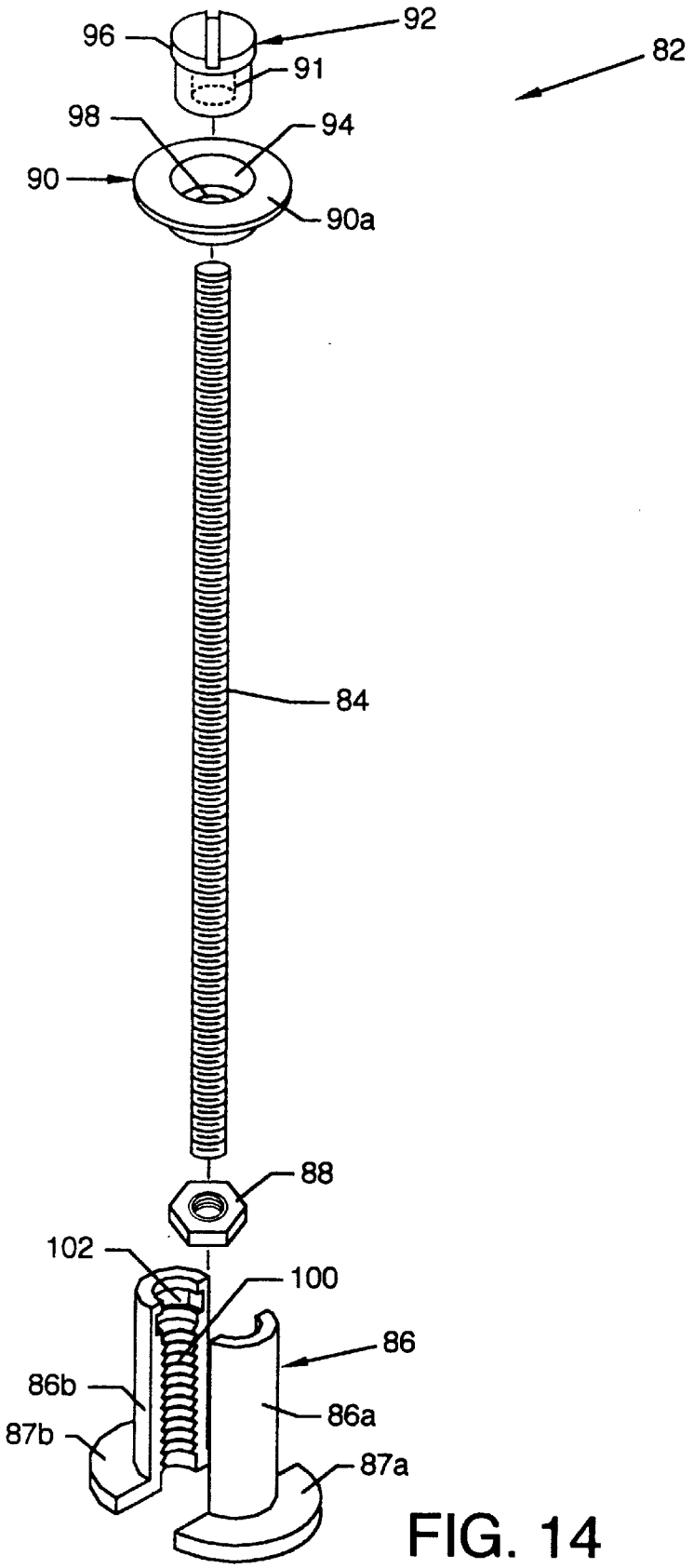
FIG. 14 illustrates an exploded isometric view of a threaded stabilizer rod assembly for use with the shelved caddy of FIG. 13.

FIG. 13, a second alternate embodiment, illustrates an isometric view of a shelved caddy 76 constructed according to the teachings and principles of the present invention, where all numerals correspond to those elements previously described. A plurality of previously described components including, but not limited to, leg assemblies 11 and 25 are incorporated to provide for multiple levels of planar shelf boards, as well as inclusion of wheels and glides. An internally located threaded stabilizer rod assembly 82 is incorporated for additional structural integrity, as illustrated in FIG. 14. Like casters 78 are inserted into the bottoms of the leg assemblies 11 at one end of the shelved caddy 76 where a pair of leg assemblies 11 connect planar shelf board 13 to planar shelf board 15, and another pair of leg assemblies 25 connects planar shelf board 15 to planar shelf board 23. The opposing end of the shelved caddy 76 incorporates a lower pair of leg assemblies 25 to connect planar shelf board 13 to planar shelf board 15 and an upper pair of leg assemblies 25 to connect planar shelf board 15 to planar shelf board 23. Additionally, like glide leg assemblies 80 connect to the lower ends of the lower leg assemblies 25 at the opposite end of the shelved caddy 76 incorporating the four leg assemblies 25.

Figure 15:
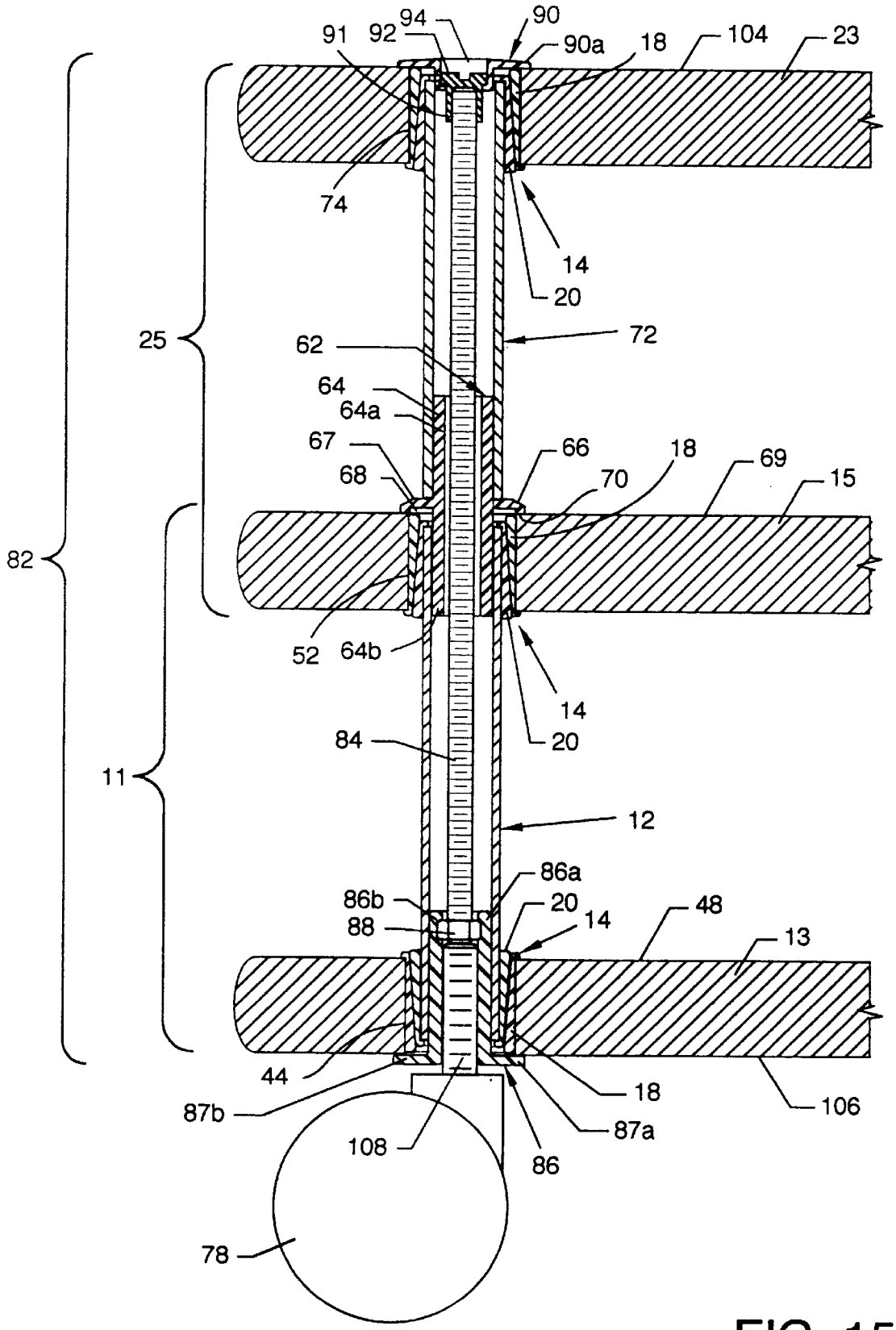
FIG. 15 illustrates a cross sectional view of the elements of FIG. 13 along line 15—15 of FIG. 13.

FIG. 14 illustrates an exploded isometric view of the threaded stabilizer rod assembly 82 including a centrally located threaded rod 84, a split flanged tubular insert 86, a nut 88, a recessed cap 90 including a disk portion 90*a*, and a cap nut 92. A recess 94 in the recessed cap 90 accommodates the shoulder 96 of the cap nut 92, a bore 98 accommodates the upper end of the threaded rod 84, and an internal bore 91 of the cap nut 92 fixedly engages and secures to the upper end of the threaded rod 84, as illustrated in FIG. 15. The split flanged tubular insert 86 includes halves 86*a* and 86*b*. Split flanged tubular insert half 86*b* reveals a threaded surface 100 and a molded interior capture surface 102 conforming to the shape of one-half of the nut 88. The split flanged tubular insert halves 86*a* and 86*b* include semicircular flanges 87*a* and 87*b*, respectively. The split flanged tubular insert half 86*a* includes like-configured surfaces, but they are not illustrated for the purpose of brevity and clarity.

FIG. 15 illustrates a cross sectional view vertically along line 15—15 of FIG. 13, where all numerals correspond to those elements previously described. Illustrated in particular is the assembled threaded stabilizer rod assembly 82 aligned coaxially through the leg assemblies 11 and 25. Cap nut 92 is rotated to rotate the threaded rod 84 in nut 88 to provide tension vertically along the threaded stabilizer rod assembly 82. This action provides for a constant vertically-applied force between the planar shelf boards 13, 15 and 23, as well as along the leg assemblies 11 and 25, thereby increasing engagemental force between the split male and female connectors 20 and 18 of the respective connector assemblies 14 by expanding the split male and female connectors 20 and 18 outwardly to further complement forcible contact of the split male and female connectors 18 and 20 with the respective planar shelf boards 13, 15 and 23. At the upper end of the threaded stabilizer rod assembly 82, the disk portion 90*a* of the recessed cap 90 overlaps the bore 74 of the planar shelf board 23 and forcibly bears upon the upper planar surface 104 on the planar shelf board 23. In a similar fashion, semicircular flanges 87*a* and 87*b* of the split flanged tubular insert 86 overlap the bore 44 of the planar shelf board 13 to forcibly bear upon the lower planar surface 106 of the planar shelf board 13. Also illustrated is a shaft 108, being part of the structure of the caster 78, inserted into the interior of the split flanged tubular insert 86 and in frictional engagement with interior threaded surface 100, best illustrated in FIG. 14.

Figure 16:
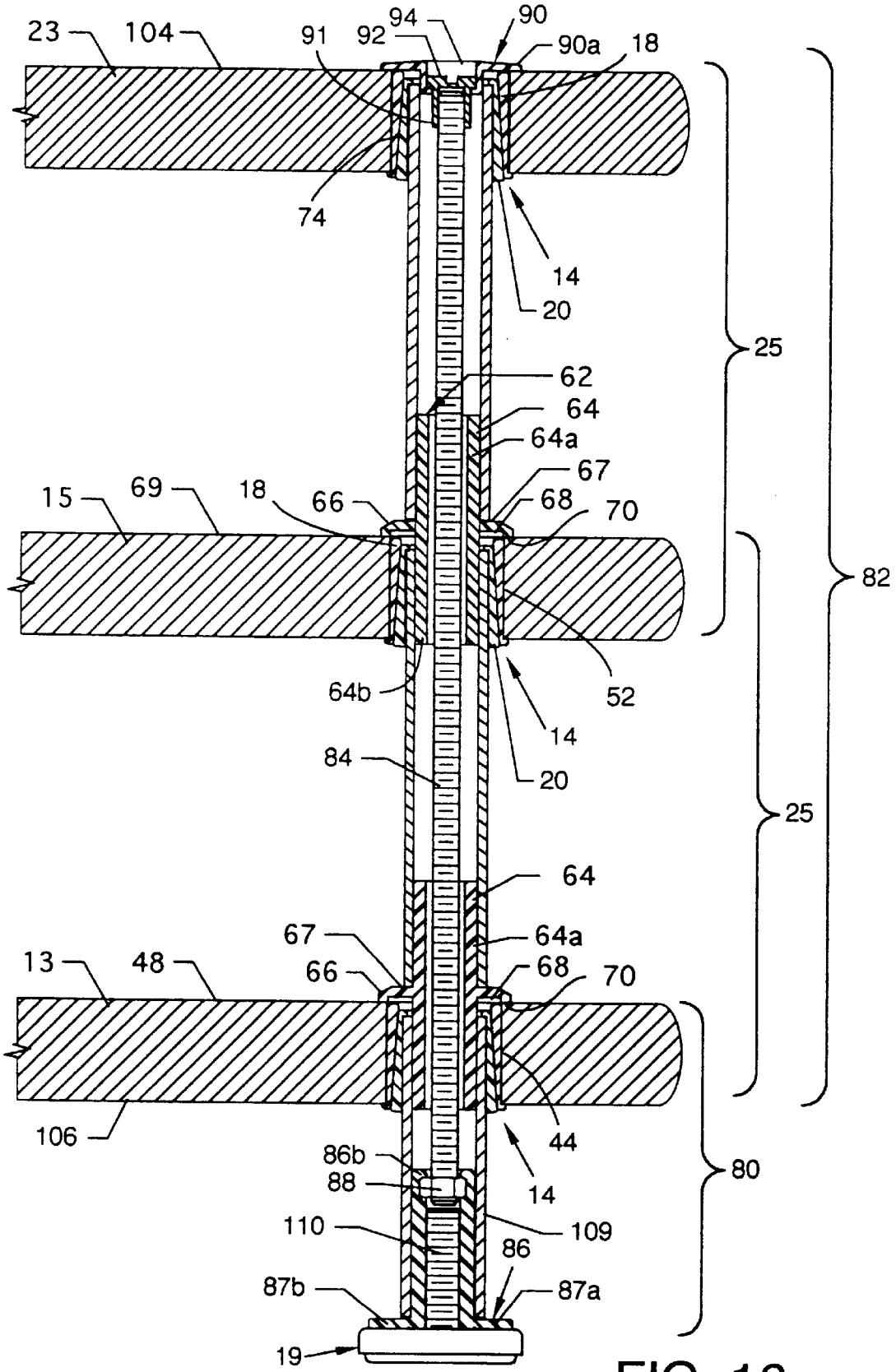
FIG. 16 illustrates a cross sectional view of the elements of FIG. 13 along line 16—16 of FIG. 13.

FIG. 16 illustrates a cross sectional view vertically along line 16—16 of FIG. 13, where all numerals correspond to those elements previously described. Illustrated in particular is the assembled threaded stabilizer rod assembly 82 aligned coaxially through the like vertically stacked leg assemblies 25 where one leg assembly 25 connects between planar shelf board 23 and planar shelf board 15, and another leg assembly 25 connects between planar shelf board 15 and planar shelf board 13. The threaded stabilizer rod assembly 82 also extends through and secures to a split flanged tubular insert 86 in the glide leg assembly 80. Cap nut 92 is rotated to rotate the threaded rod 84 in nut 88 to provide tension vertically along the threaded stabilizer rod assembly 82. This action provides for a constant vertically-applied force between the planar shelf boards 13, 15 and 23, as well as along the multiple leg assemblies 25 and the glide leg assembly 80, thereby increasing engagemental force between the split male and female connectors 20 and 18 of the respective connector assemblies 14 by expanding the split male and female connectors 20 and 18 outwardly to further complement forcible contact of the split male and female connectors 18 and 20 with the respective planar shelf boards 13, 15 and 23. The upper portion of tubular leg 109 engages the interior of connector assembly 14 located in bore 44 in planar shelf board 13. A split flanged tubular insert 86 is located in the lower interior portion of the tubular leg 109. Semicircular flanges 87*a* and 87*b*, being forced upward by the action of the threaded rod 84 and nut 88, bear upon the lower portion of the tubular leg 109 to distribute pressure across the planar shelf boards 13, 15 and 23. At the upper end of the threaded stabilizer rod assembly 82, the disk portion 90*a* of the recessed cap 90 overlaps a bore 74 of the planar shelf board 23 and forcibly bears upon the upper planar surface 104 on the planar shelf board 23. Also illustrated is a shaft 110, being part of the structure of the glide 19, inserted into the interior of the split flanged tubular insert 86 and in threaded engagement with interior threaded surface 100, best illustrated in FIG. 14.

Figure 17:
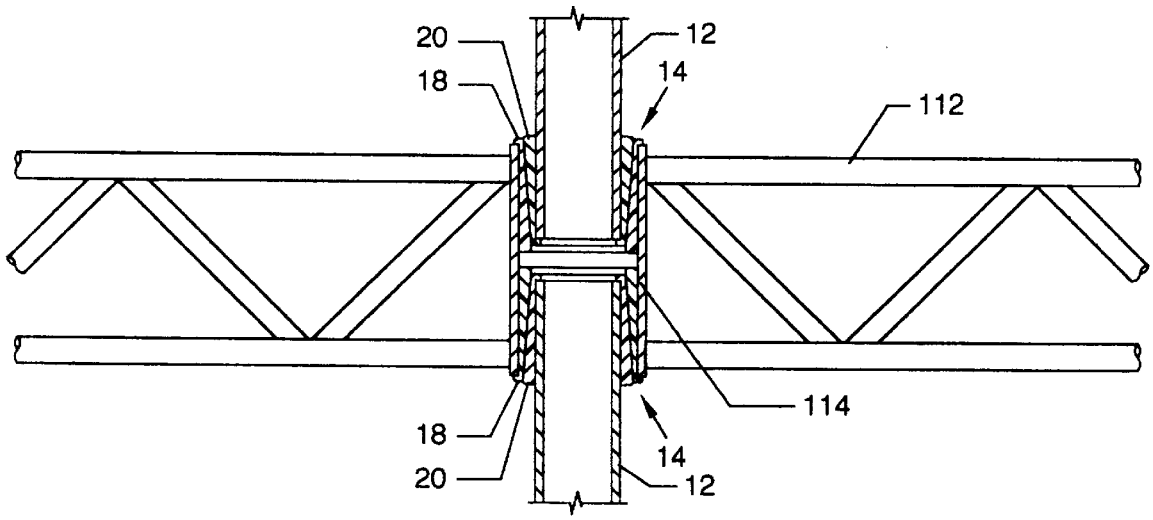
FIG. 17, a third alternate embodiment, illustrates the support of wire shelving by components of the invention.

FIG. 17, a third alternate embodiment, illustrates the support of wire shelving by previously described components of the invention and other such components, as now described, and where all numerals correspond to those elements previously described. Wire shelving 112 is suitably secured, such as by welding, to appropriate areas of a vertically aligned tube 114, preferably of anodized aluminum. A lower leg, such as leg 12, including a connector assembly 14 at its upper end, frictionally engages the lower region of the tube 114 according to the teachings and principles of the present invention. Another similarly fashioned leg 12 having a connector assembly 14 aligned over and about its lower end can be inserted into the upper region of the tube 114 for support of additional wire shelving or other shelving at a higher level, if desired.

Figure 18:
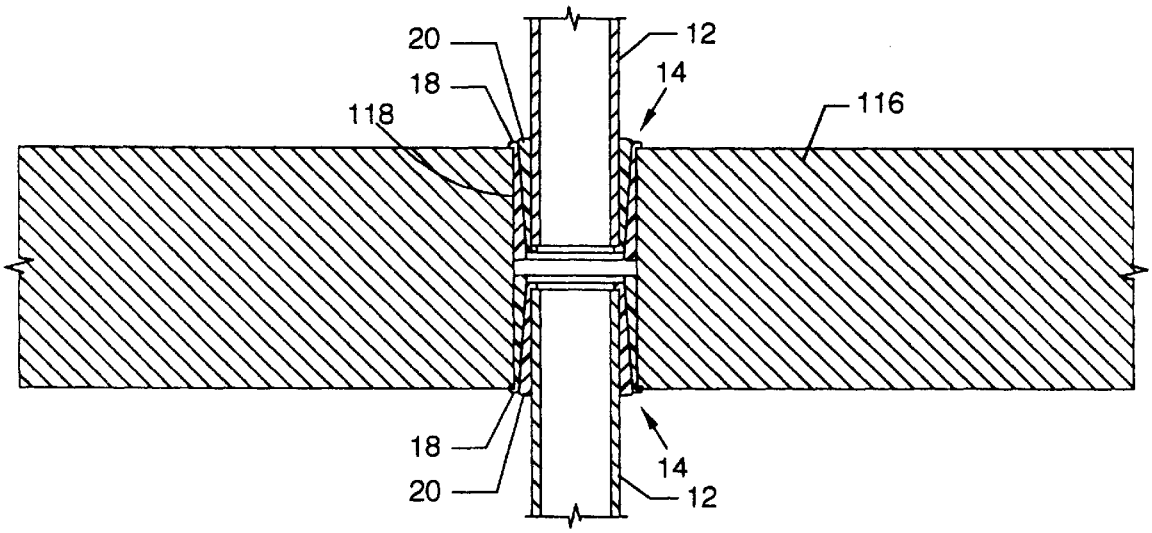
FIG. 18, a fourth alternate embodiment, illustrates the support of a thick planar shelf board by components of the invention.

FIG. 18, a fourth alternate embodiment, illustrates the support of a thick planar shelf board 116 by a plurality of connector assemblies 14, where all numerals correspond to those elements previously described. Thick planar shelf board 116 includes a bore 118. A lower leg, such as leg 12, including a connector assembly 14 at its upper end, frictionally engages the lower region of the bore 118 according to the teachings and principles of the present invention. Another similarly fashioned leg 12, having a connector assembly 14 aligned over and about its lower end, can be inserted into the upper region of the bore 118 for support of additional shelving at a higher level, if desired.

Figure 19:
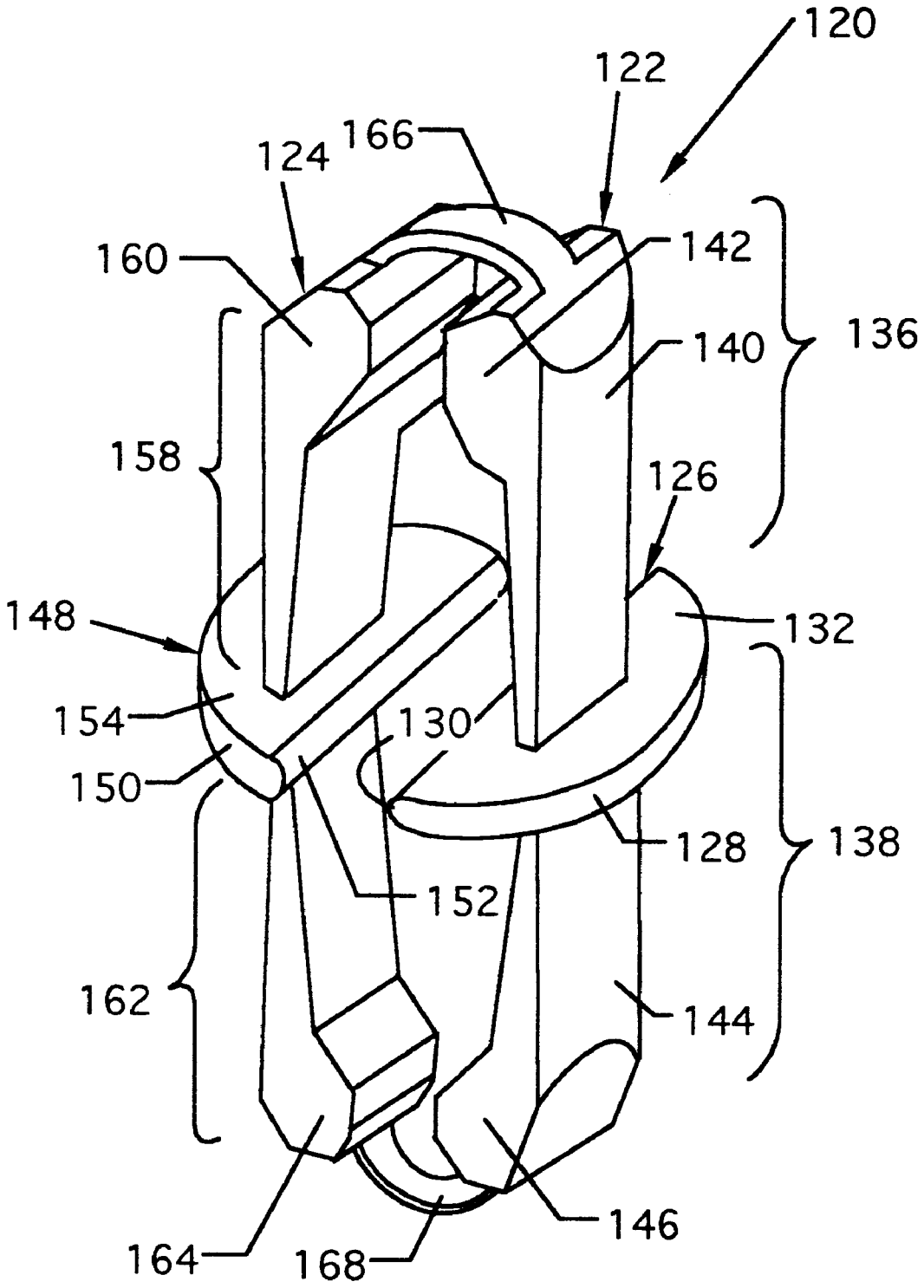
FIG. 19 illustrates an isometric view of a one-piece flexible flanged connector which constitutes the primary component of a fifth alternate shelf assembly system embodiment constructed of planar shelf boards and tubular legs having tapered ends.
Figure 20:
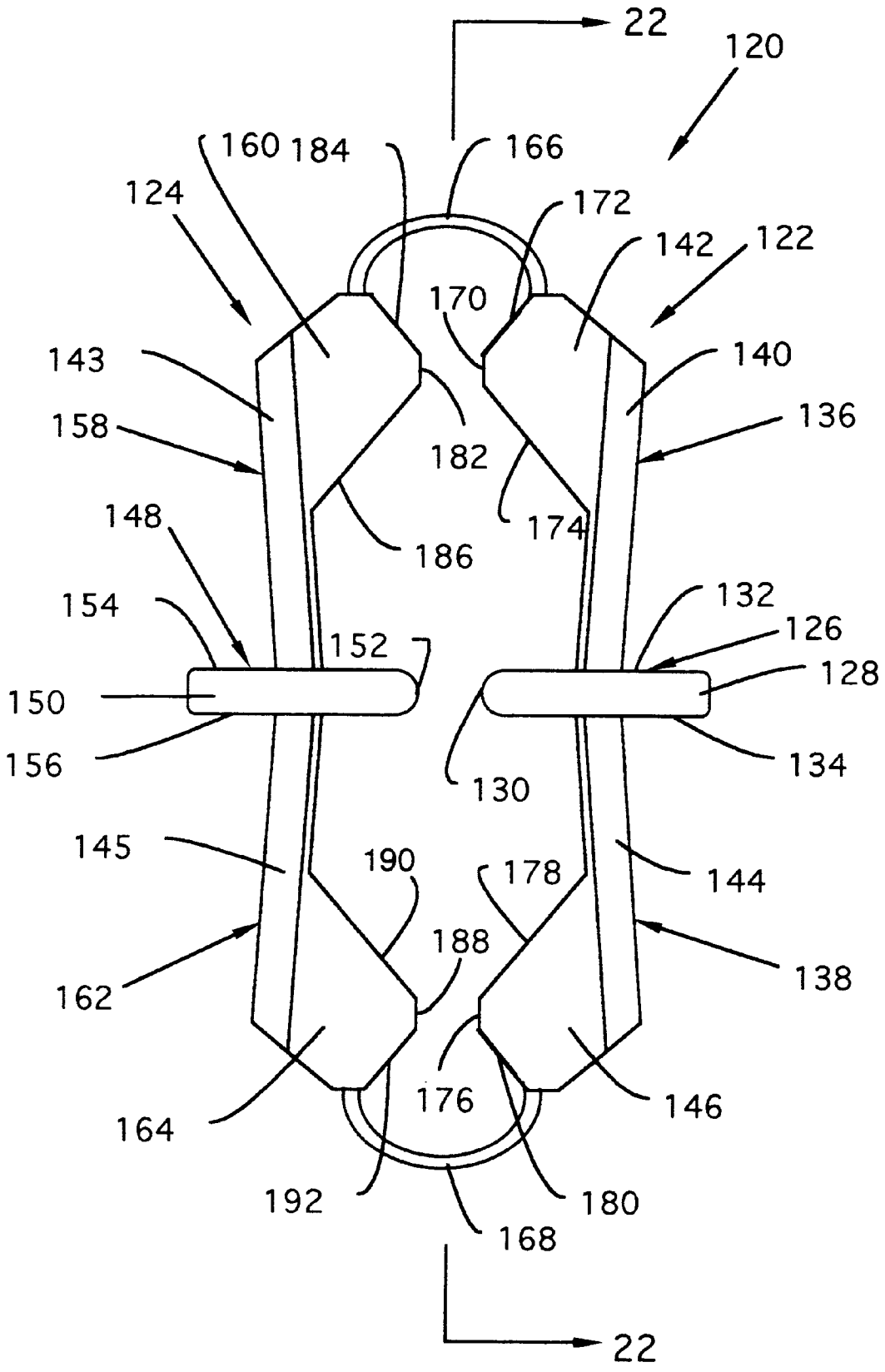
FIG. 20 illustrates a front view of the one-piece flexible flanged connector.

FIG. 19 illustrates an isometric view of a one-piece flexible flanged connector 120 which constitutes the primary component of a fifth alternate shelf assembly system embodiment constructed with tubular legs having tapered ends. The one-piece flexible flanged connector 120 is composed of mirror image-like right and left structures 122 and 124 of similar form and construction. Some members of the right structure 122 include a centrally located and horizontally aligned planar semi-circular flange 126 having an outwardly facing circumferential edge 128, an inwardly facing edge 130 having a semi-circular cross section, and an upper planar surface 132 and a lower planar surface 134 (FIG. 20) located between the outwardly facing circumferential edge 128 and the inwardly facing edge 130. Also included as members of the right structure 122 are an upper cam 136 extending upwardly from the upper planar surface 132 of the semi-circular flange 126 and a lower cam 138 extending downwardly from the lower planar surface 134 of the semi-circular flange 126 in opposition to the upper cam 136. The upper and lower cams 136 and 138 are mirror-like images of each other. The upper cam 136 extends upwardly from the semi-circular flange 126 and includes an outwardly facing truncated curved surface 140 which corresponds to the radius of the tapered end of a cylindrical tubular leg, as shown later in detail. The truncated curved surface 140 of the upper cam 136 is also offset at an angle from the vertical axis of the flexible flanged connector 120 for accommodation by the tapered end of a cylindrical tubular leg. A cam node 142 is located at the upper region of the upper cam 136 and is described later in detail in relation to FIG. 20. The lower cam 138 includes an outwardly facing truncated curved surface 144 which corresponds to the radius of the tapered end of a cylindrical tubular leg, as shown later in detail, and is also offset at an angle from the vertical axis of the flexible flanged connector 120 for accommodation by the tapered end of a cylindrical tubular leg. A cam node 146 is located at the lower region of the lower cam 138 and is described later in detail in relation to FIG. 20. The upper portion of the lower cam 138 is also tapered to provide flexibility along the length of the lower cam 138 in such a manner that the greatest degree of flexibility exists at or near the junction of the lower cam 138 with the semi-circular flange 126. The left structure 124 is fashioned and constructed in mirror-like fashion reflecting the geometry of the right structure 122 and includes a planar semi-circular flange 148 having an outwardly facing circumferential edge 150, an inwardly facing edge 152 having a semi-circular cross section, and upper and lower planar surfaces 154 and 156 (FIG. 20), respectively, located between the outwardly facing circumferential edge 150 and the inwardly facing edge 152, an upper cam 158 having a cam node 160 and a truncated curved surface 143 (FIG. 20), and a lower cam 162 having a cam node 164 and a truncated curved surface 145 (FIG. 20). The right and left structures 122 and 124 are flexibly joined by a flexible living hinge 166 joining cam nodes 142 and 160 at the upper regions of the upper cams 136 and 158 and by a flexible living hinge 168 joining cam nodes 146 and 164 at the lower regions of the lower cams 138 and 162.

FIG. 20 illustrates a front view of the flexible flanged connector 120, where all numerals correspond to those elements previously or otherwise described. Illustrated in particular are the cam nodes 142, 146, 160 and 164, each having similarly constructed and opposing corresponding surfaces. Cam node 142 includes a vertically aligned surface 170, an upper angled surface 172 intersecting surface 170, and a lower angled surface 174 also intersecting surface 170. Cam node 146 being similarly constructed in mirror image-like fashion includes a vertically aligned surface 176, an upper angled surface 178 intersecting surface 176, and a lower angled surface 180 also intersecting surface 176. Cam node 160 being similarly constructed includes a vertically aligned surface 182, an upper angled surface 184 intersecting surface 182, and a lower angled surface 186 also intersecting surface 182. Cam node 164 being similarly constructed in mirror image-like fashion includes a vertically aligned surface 188, an upper angled surface 190 intersecting surface 188, and a lower angled surface 192 also intersecting surface 188.

Figure 21:
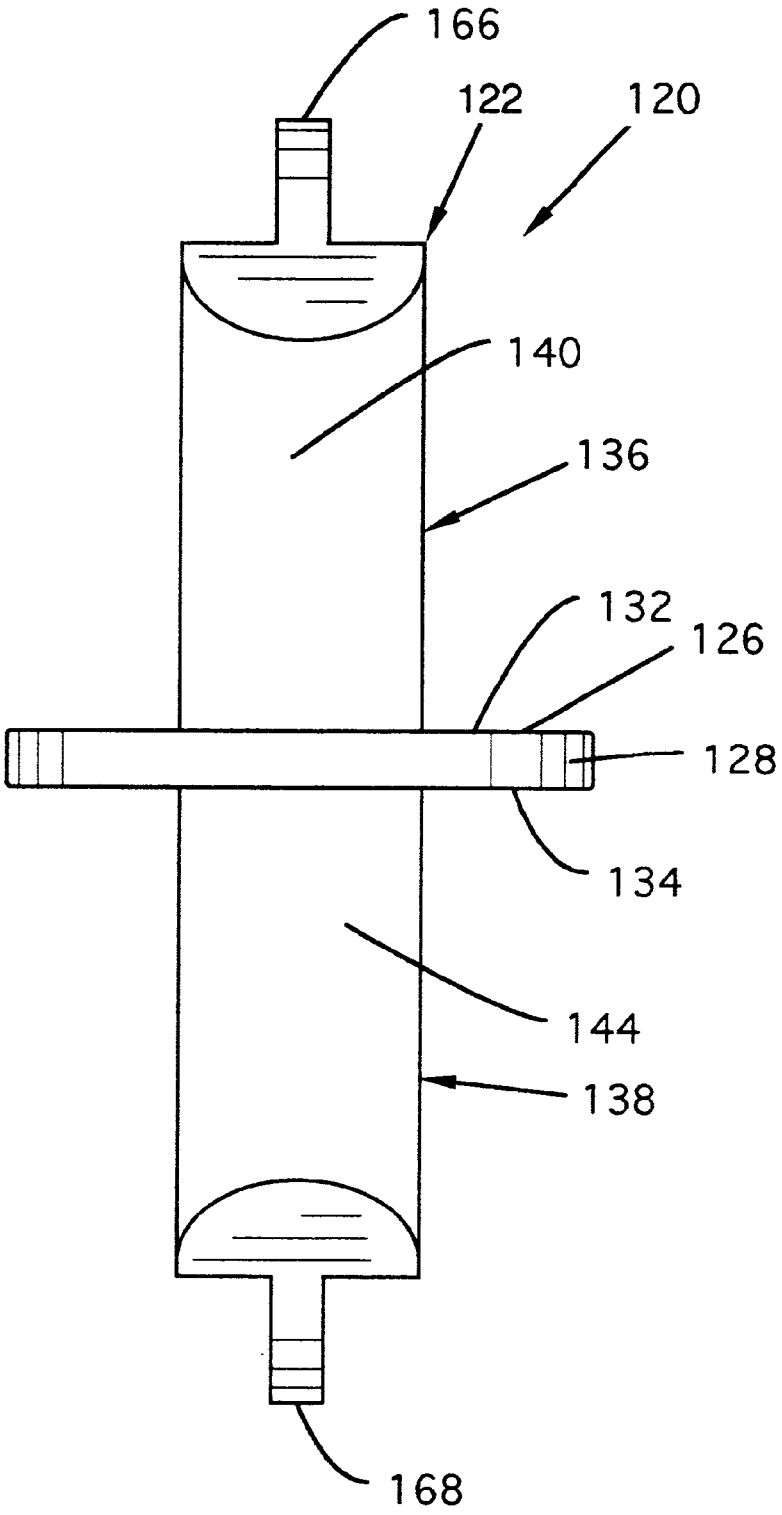
FIG. 21 illustrates a side view of the one-piece flexible flanged connector.

FIG. 21 illustrates a side view of the flexible flanged connector 120 with particular attention to the right structure 122 containing the upper cam 136 and the lower cam 138, where all numerals correspond to those elements previously or otherwise described. A side view of the flexible flanged connector 120 with particular attention to the left structure 124 containing the upper cam 158 and the lower cam 162 would be similar with the exception of the numerical component numbers which would correspond to those previously or otherwise described.

Figure 22:
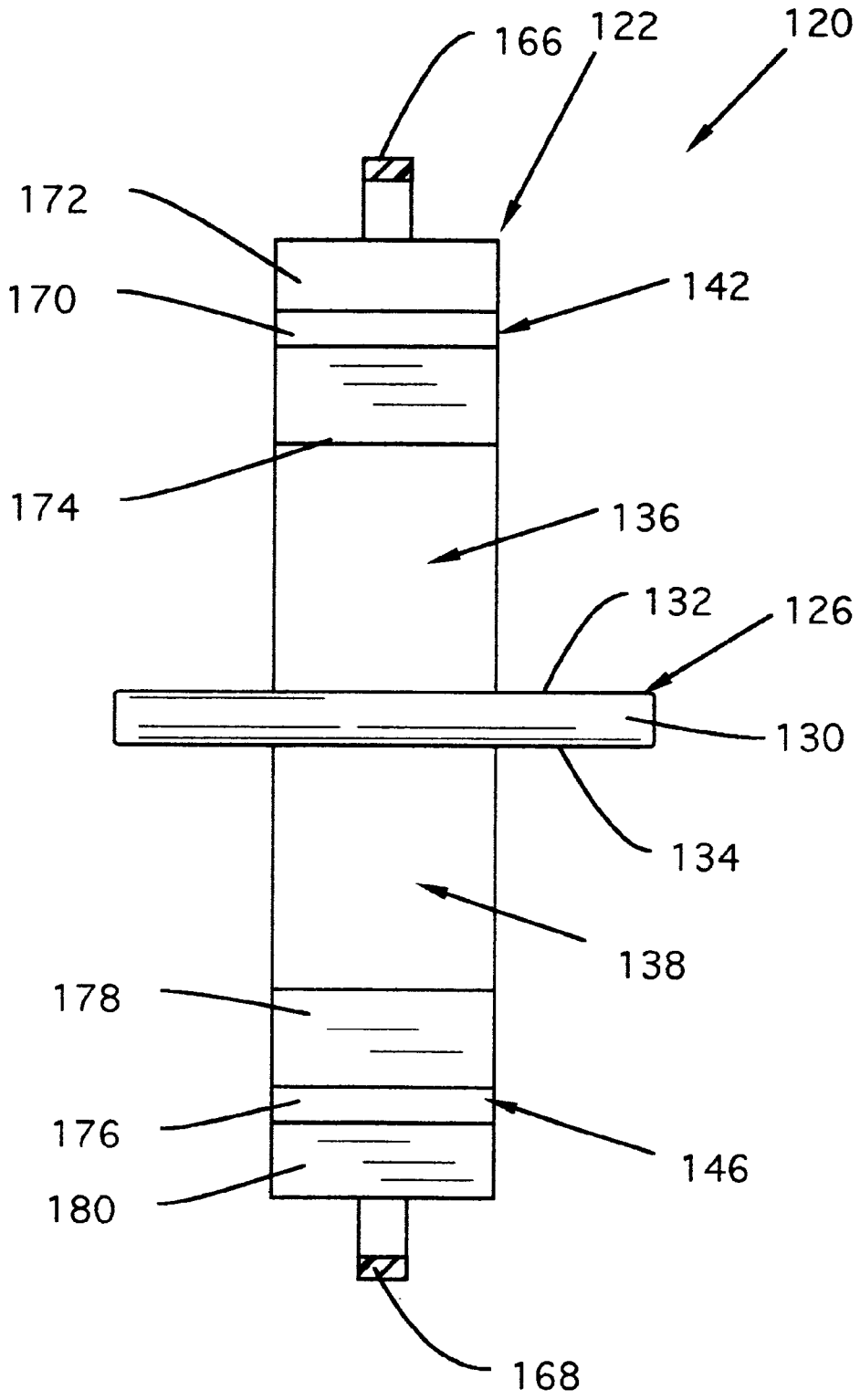
FIG. 22 illustrates a cross sectional view of the one-piece flexible flanged connector along the line 22—22 of FIG. 20.

FIG. 22 illustrates a cross sectional view along line 22—22 of FIG. 20 of the flexible flanged connector 120 with particular attention to the right structure 122, where all numerals correspond to those elements previously or otherwise described. Illustrated in particular are the vertically aligned surface 170 and upper and lower angled surfaces 172 and 174 which intersect the vertically aligned surface 170, all of which are inwardly facing on the inner portion of the upper cam node 142, and the vertically aligned surface 176 and upper and lower angled surfaces 178 and 180 which intersect the vertically aligned surface 176, all of which are inwardly facing on the inner portion of the lower cam node 146. A corresponding view of the flexible flanged connector 120 with particular attention to the left structure 124 containing the upper cam node 160 and the lower cam node 164 would be similar with the exception of the numerical component numbers which would correspond to those previously or otherwise described.

Figure 23:
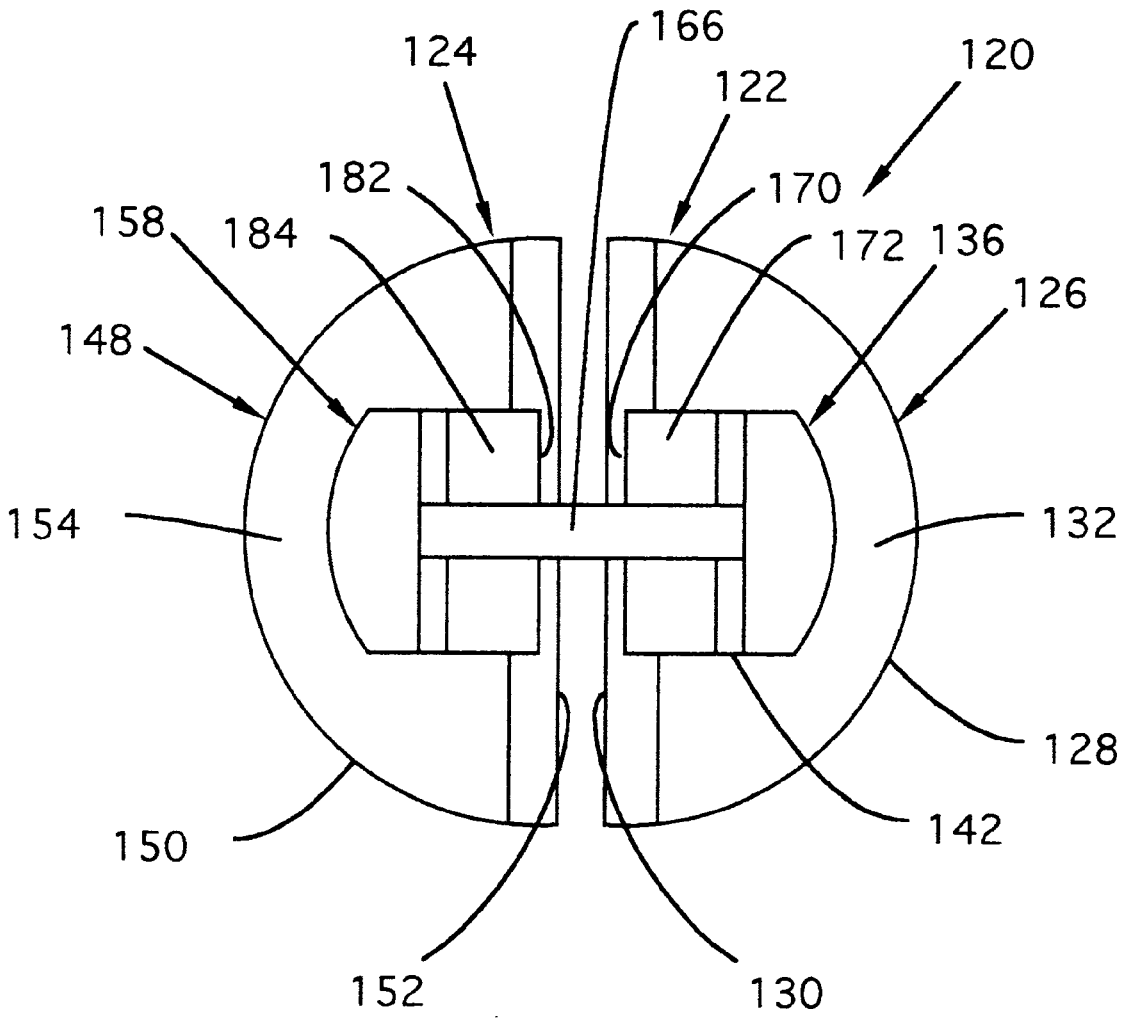
FIG. 23 illustrates a top view of the one-piece flexible flanged connector.
Figure 25:
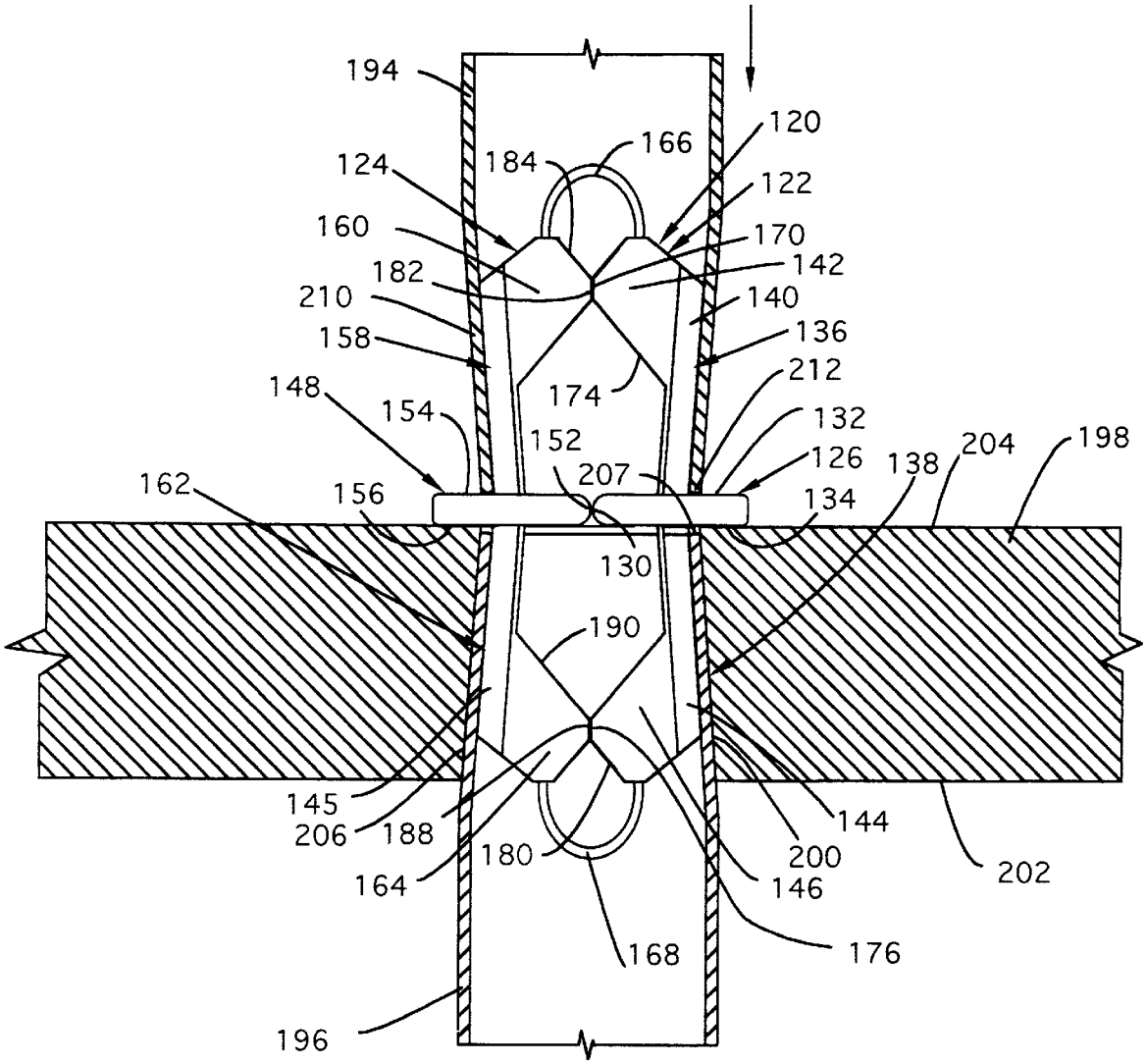
FIG. 25 illustrates the final step in the method of incorporating the one-piece flexible flanged connector to connect and secure together tubular legs having tapered ends to a planar shelf board.

FIG. 23 illustrates a top view of the flexible flanged connector 120, where all numerals correspond to those elements previously or otherwise described. The outwardly facing truncated curved surface 140 of the upper cam 136 and the outwardly facing truncated curved surface 143 of the upper cam 158 are arced or otherwise appropriately shaped to accommodate and frictionally engage the inner surface of a tapered end of a tubular leg, as shown in FIG. 25. In a similar fashion and with reference to FIG., 25, the outwardly facing truncated curved surface 145 of the lower cam 162 and the outwardly facing truncated curved surface 144 of the lower cam 138 are arced or otherwise appropriately shaped to accommodate and frictionally engage the inner surface of a tubular leg.

Figure 24:
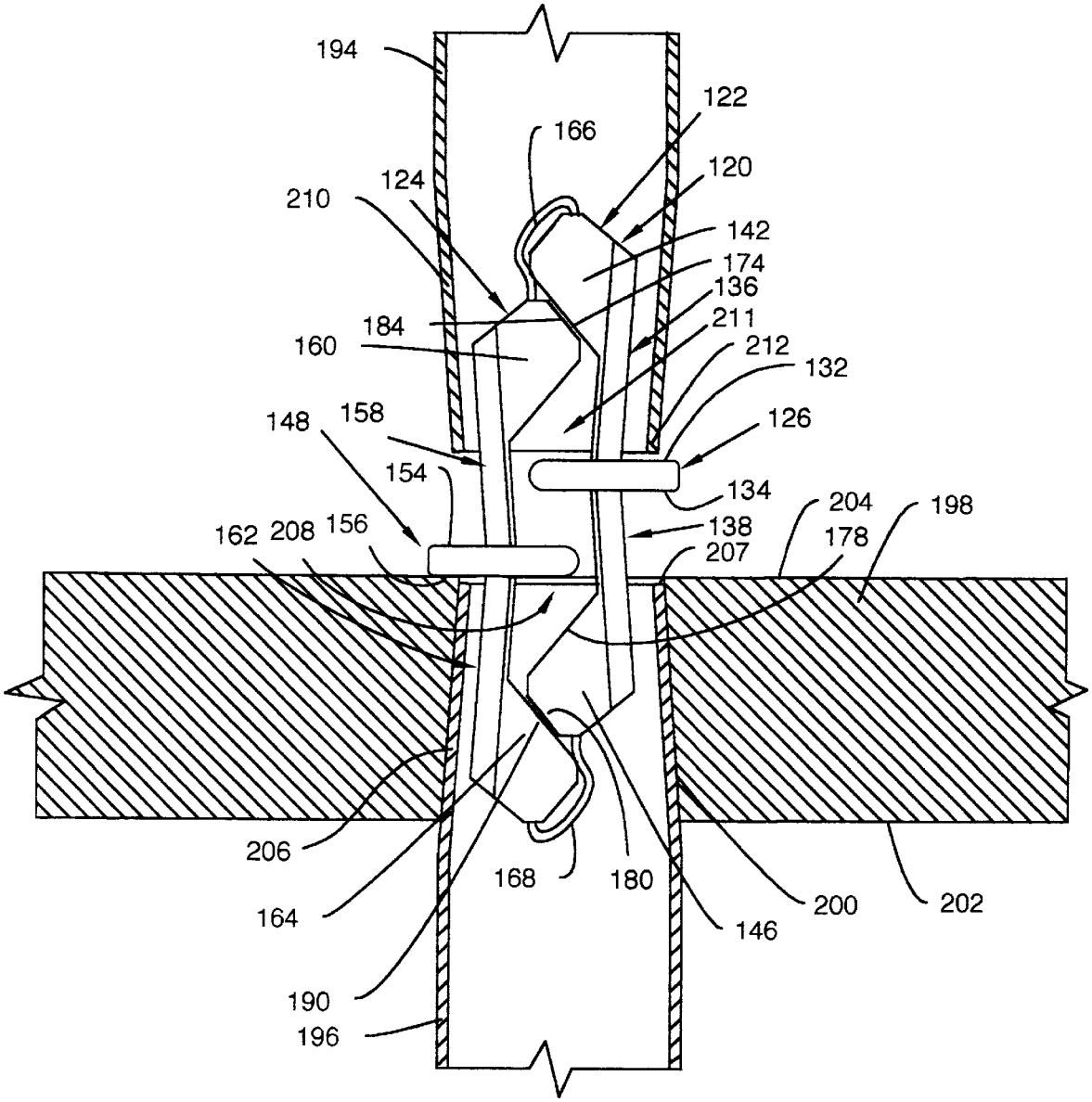
FIG. 24 illustrates the initial step in the method of incorporating the one-piece flexible flanged connector to connect and secure together tubular legs having tapered ends to a planar shelf board.

FIG. 24 illustrates the initial step in the method of incorporating the flexible flanged connector 120 to connect and secure the upper and lower tubular legs 194 and 196 to an intermediate planar shelf board 198, where all numerals correspond to those elements previously or otherwise described. The shelf board 198 presents a tapered bore 200 having its largest radius at the shelf board bottom planar surface 202 and its smallest radius at the shelf board top planar surface 204. The tapered end 206 of the lower tubular leg 196, the taper of which corresponds to the taper of the tapered bore 200, closely aligns in the tapered bore 200. The annular tip 207 at the end of the tapered end 206 is spaced from the top planar surface 204 of the planar shelf board 198 to prevent contact with the semi-circular flanges 126 and 148 for purposes of vertical load distribution, as later described in detail. The tapered end 206 of the lower tubular leg 196 is inserted into close engagement with the tapered bore 200 from the underside of the planar shelf board 198. The flexible flanged connector 120 is then manually flexed to displace the left structure 124 vertically with respect to the right structure 122 either upwardly or downwardly. In the figure, the left structure 124 is shown positioned downwardly with respect to the right structure 122, whereby the flexible living hinges 166 and 168 are exercised to yet maintain a vertical and horizontal but changed relationship between the left structure 124 and the right structure 122. The left structure 124 and the right structure 122 are also urged inwardly and nested together as shown, whereby the left structure 124 and the right structure 122 are in close juxtaposition. Subsequent to manual vertical displacement of the left structure 124 and the right structure 122, and during manual inward displacement of the left structure 124 and the right structure 122 towards each other, the cam nodes residing on the upper and lower cams 136 and 138 of the right structure 122 and the upper and lower cams 158 and 162 of the left structure 124 interact to assist in proper positioning and placement of the left structure 124 with respect to the right structure 122. The lower angled surface 174 of the cam node 142 interacts with the upper angled surface 184 of the cam node 160 and the lower angled surface 180 of the cam node 146 interacts with the upper angled surface 190 of the cam node 164 to allow appropriate and desired inward positioning of left structure 124 against the right structure 122. During the inward movement and during the vertical displacement of the left structure 124 and the right structure 122, the distance between the lower cam 138 of the right structure 122 and the lower cam 162 of the left structure 124, as well as the distance between the upper cam 136 of the right structure 122 and the upper cam 158 of the left structure 124, is minimized to allow passage of the displaced cam nodes 146 and 164, all of the lower cam 162, and part of the lower cam 138 for a relaxed fit into an orifice 208 at the upper and minimally dimensioned portion of the tapered end 206 of the lower tubular leg 196. An orifice 211 in the tapered end 210 of the upper tubular leg 194 is then lowered over and about the upper portion of the flexible flanged connector 120 in a relaxed fit about the displaced cam nodes 142 and 160, all of the upper cam 136, and part of the upper cam 158. It is noted that the left structure 124 and the right structure 122 are sprung outwardly against the orifice 208 at the upper portion of the tapered end 206 by action of the flexible living hinges 166 and 168 to aid in vertical positioning of the flexible flanged connector 120 for ready and easy alignment with the subsequently placed upper tubular leg 194. Final positioning of the upper tubular leg 194 and of the flexible flanged connector 120 is accomplished as described in relation to FIG. 25.

FIG. 25 illustrates the final step in the method of securing the upper tubular leg 194 and the lower tubular leg 196 to the intermediate planar shelf board 198 by incorporation of the flexible flanged connector 120, where all numerals correspond to those elements previously or otherwise described. Downwardly forced pressure is applied manually to the upper tubular leg 194 to reposition the elements of the flexible flanged connector 120 for intimate and secure frictional engagement with the upper and lower tubular legs 194 and 196 and with the intermediate planar shelf board 198. Repositioning of the elements of the flexible flanged connector 120 restores vertical alignment of the right structure 122 and the left structure 124, such as shown in FIG. 20; however, the horizontal alignment is such that the right structure 122 and the left structure 124 are brought into close and intimate mutual contact to secure the upper tubular leg 194 and the lower tubular leg 196 to the intermediate planar shelf board 198. Vertical and horizontal repositioning of the right structure 122 and the left structure 124 is best illustrated by reference to FIGS. 24 and 25. As shown in FIGS. 24 and 25, the lower planar surface 156 of the semi-circular flange 148 aligns to and bears upon the top planar surface 204 of the planar shelf board 198, thereby vertically fixing the position of the left structure 124 with respect to the planar shelf board 198. The right structure 122, however, as shown in FIG. 24, is subject to vertical positioning with respect to the planar shelf board 198 and, more importantly, is subject to vertical positioning with respect to the opposing left structure 124 and is positioned downwardly by the downward force provided through the downwardly urged upper tubular leg 194, as shown in FIG. 25. The lower tip 212 of the upper tubular leg 194, located at the bottom of the upper tubular leg tapered end 210, impinges the upper planar surface 132 of the semi-circular flange 126 to vertically and downwardly reposition the right structure 122 with respect to the opposing left structure 124 and with respect to the planar shelf board 198. Forced downward vertical positioning of the right structure 122 causes the upper and lower cams 136 and 138 of the right structure 122 to interface and interact with the upper and lower cams 158 and 162 of the left structure 124 and to reposition and align the right structure 122 with the left structure 124. Forced downward vertical positioning of the right structure 122 also brings the lower planar surface 134 of the semi-circular flange 126 into alignment with and to bear upon the top planar surface 204 of the planar shelf board 198. In the downward movement of the right structure 122, the lower angled surface 174 of the cam node 142 acts in concert with and along the upper angled surface 184 of the cam node 160 and the upper angled surface 190 of the cam node 164 acts in concert with and along the lower angled surface 180 of the cam node 146 to force the right structure 122 downwardly and to the right to the position shown in FIG. 25. The opposing vertically aligned surfaces 170 and 182 of the opposing cam nodes 142 and 160 and the opposing vertically aligned surfaces 176 and 188 of the opposing cam nodes 146 and 164 are brought, respectively, into oppositional alignment to force the cam nodes 142, 160, 146 and 164 outwardly to force the upper portions of the truncated curved surfaces 140 and 143, and the lower portions of the truncated curved surfaces 144 and 145 into intimate and forced contact and angular engagement against the respective inner surfaces of the tapered ends 210 and 206 of the upper and lower tubular legs 194 and 196. Additional positioning forces are also brought into play during the vertical repositioning of the right structure 122, in that the inwardly facing edges 130 and 152, each having a semi-circular cross section, of the semi-circular flange 126 and semi-circular flange 148, respectively, are forced into sliding and forced oppositional engagement to force the lower portions of the truncated curved surfaces 140 and 143, and the upper portions of the truncated curved surfaces 14 4 and 14 5 of the respective cams 136, 158, 138 and 162 into intimate and forced contact and angular engagement against the respective inner surfaces of the tapered ends 210 and 206 of the upper and lower tubular legs 194 and 196. Thus, the upper tubular leg 194 and the lower tubular leg 196 are secured to the intermediate planar shelf board 198.

A cumulative vertical stacking effect is provided for in the stacking of a plurality of planar shelf boards 198, i.e., more weight (more shelves and more load) is applied along the vertical axis in an assembled board and leg structure, the strength of the unions of the planar shelf boards 198 with the tubular legs 194 and 196 and other like and corresponding members is increased. As an example, load is transferred from the lower tip 212 of the upper tubular leg 194 to the semi-circular flanges 126 and 148, thence to the top planar surface 204 of the planar shelf board 198, then to the tapered bore 200 and then to the tapered end 206 of the lower tubular leg 196. As more weight is applied, the force of frictional engagement of the tapered end 206 in the tapered bore 200 is increased to lend and add stability vertically and horizontally along and about the combined structures. In the alternative, the elements of FIG. 24 can be inverted vertically and the cumulative stacking effect utilized to lend and add stability vertically and horizontally along and about the combined structures.

Figure 28:
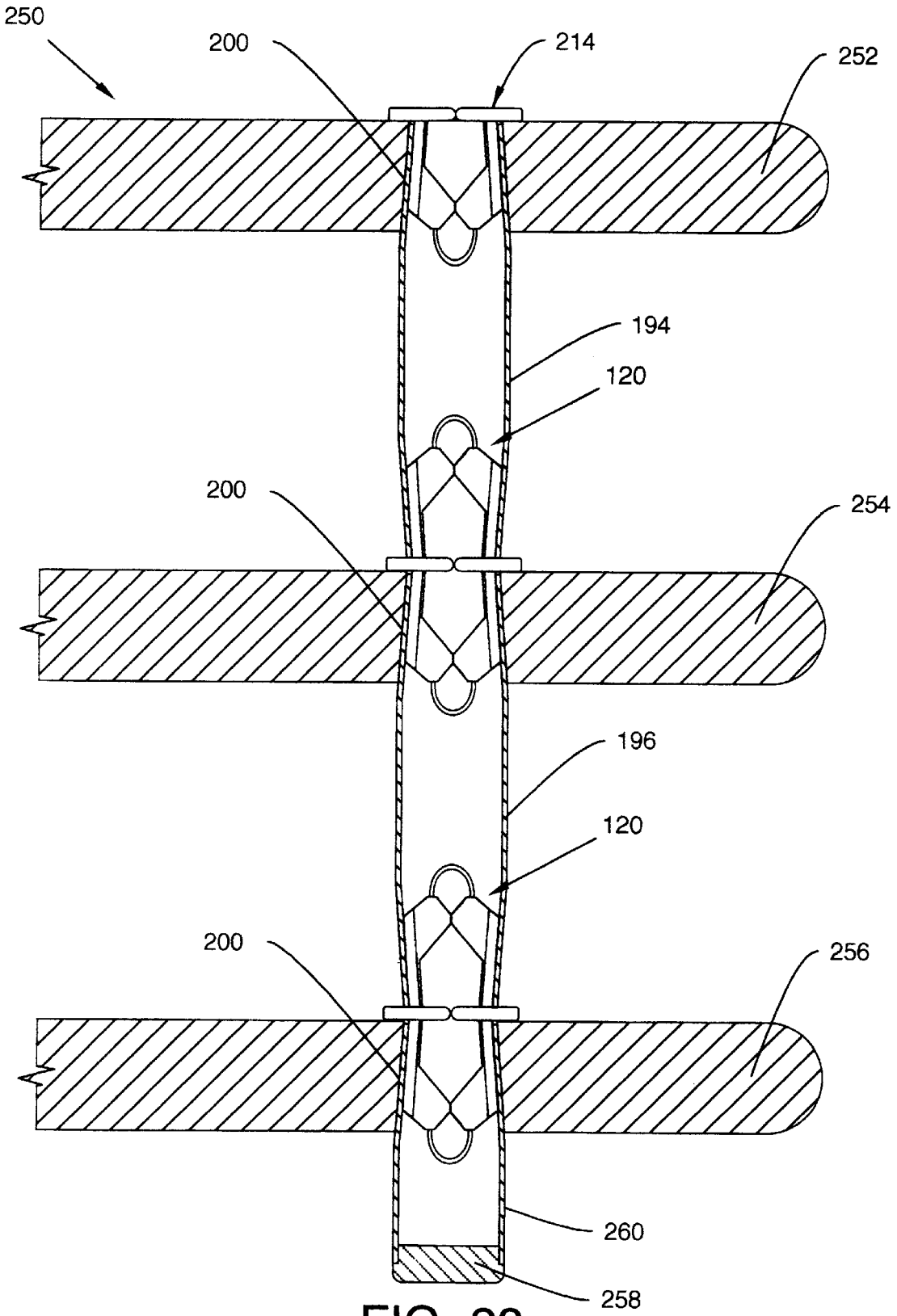
FIG. 28, a fifth alternate embodiment, illustrates a cross sectional view of one end of a shelf assembly system composed of planar shelf boards and tubular legs having tapered ends connected together with the one-piece flexible flanged connectors; and, FIG. 29 illustrates a cross sectional view of a modified shelf board and tubular leg connecting arrangement incorporating the one-piece flexible flanged connector and a split female connector.

The secure union of the tubular legs to planar shelf boards, featuring a wedge to taper relationship and as shown in FIGS. 25 and 28, allows the combined components to be manually picked up without the risk of component disengagement. If, as an example and as viewed in FIG. 25, the upper tubular leg 194 were grasped and moved upwardly, the wedge-like geometry and tapered geometry relationship, such as the wedge-like profile of the upper cams 136 and 158 and the tapered end 210 of the upper tubular leg 194, is strengthened and serves to enhance the frictional engagement therebetween. In a somewhat similar fashion, the same relationship exists between the wedge-like geometry and tapered geometry relationship, such as the wedge-like profile of the lower cams 138 and 162 and the tapered end 206 of the lower tubular leg 196, and is strengthened and serves to enhance the frictional engagement therebetween. If an upward force were applied to the planar shelf board 198 and a downward force were applied to the lower tubular leg 196, the wedge-to-taper relationship therebetween would prevent disengagement of the lower tubular leg 196 from the planar shelf board 198.

Figure 26:
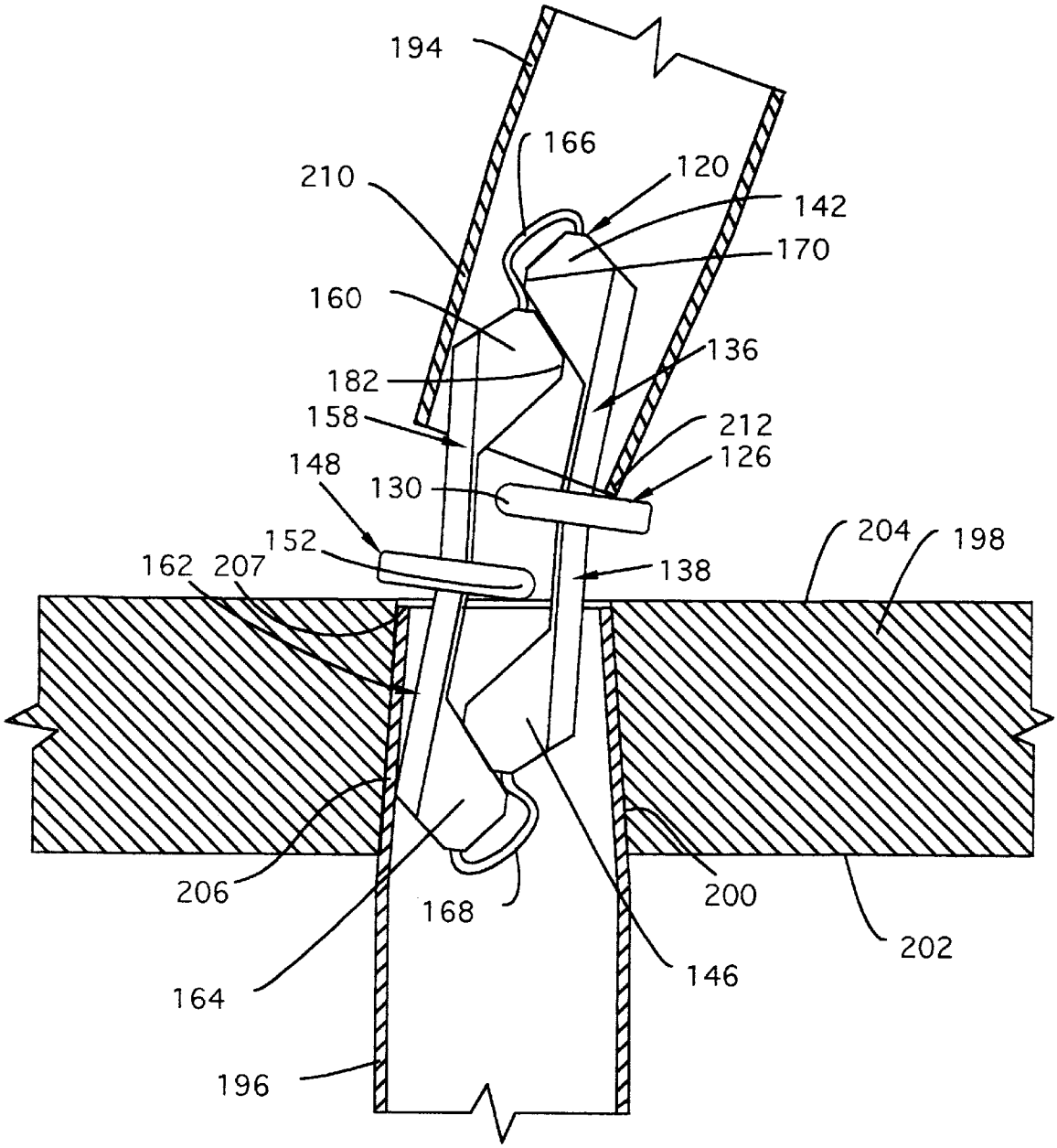
FIG. 26 illustrates the method of disengagement of the tubular legs having tapered ends from the one-piece flexible flanged connector and the planar shelf board.

FIG. 26 illustrates the method of disengagement of the upper and lower tubular legs 194 and 196 from the flexible flanged connector 120 and from the planar shelf board 198, where all numerals correspond to those elements previously or otherwise described. Disengagement is initiated by tilting and forcing the upper region of the upper tubular leg 194 to the right (or to the left) to distort and to displace the elements of the flexible flanged connector 120. The tapered end 210 of the upper tubular leg 194 acts upon the upper cam 158 to distort and flex the upper cam 158, as well as the entire left structure 124. As the cam node 160 at the upper region of the upper cam 158 is urged to the right, the vertically aligned surfaces 170 and 182 of the cam node 142 and the cam node 160, respectively, and the vertically aligned surfaces 176 and 188 of the cam node 146 and the cam node 164, respectively, disengage to allow repositioning of the cam nodes 142, 160, 146 and 164, as shown, to alter and deform the otherwise desirable wedge-to-taper relationship in favor of disassembly. Continued movement of the upper tubular leg 194 to the right causes the upper cam 158 to deflect further to the right, thereby causing the semi-circular flange 148 to tip and reposition from horizontal alignment. The cam node 160 at the top of the upper cam 158 interacts with the cam node 142 at the top of the opposing upper cam 136 to reposition the upper cam 136, as well as the entire right structure 122, upwardly and to the right. During this repositioning, the semi-circular flange 126 causes the semi-circular flange 148 to tip and reposition from horizontal alignment, thereby removing the inwardly facing edges 130 and 152 of the semi-circular flanges 126 and 148 from mutual influence. Disalignment and movement of the right and left structures 122 and 124 to the once again nested or nearly nested position allows removal of the upper regions of the right and left structures 122 and 124 from the tapered ends 210 and 206 of the upper and lower tubular legs 194 and 196.

Figure 27:
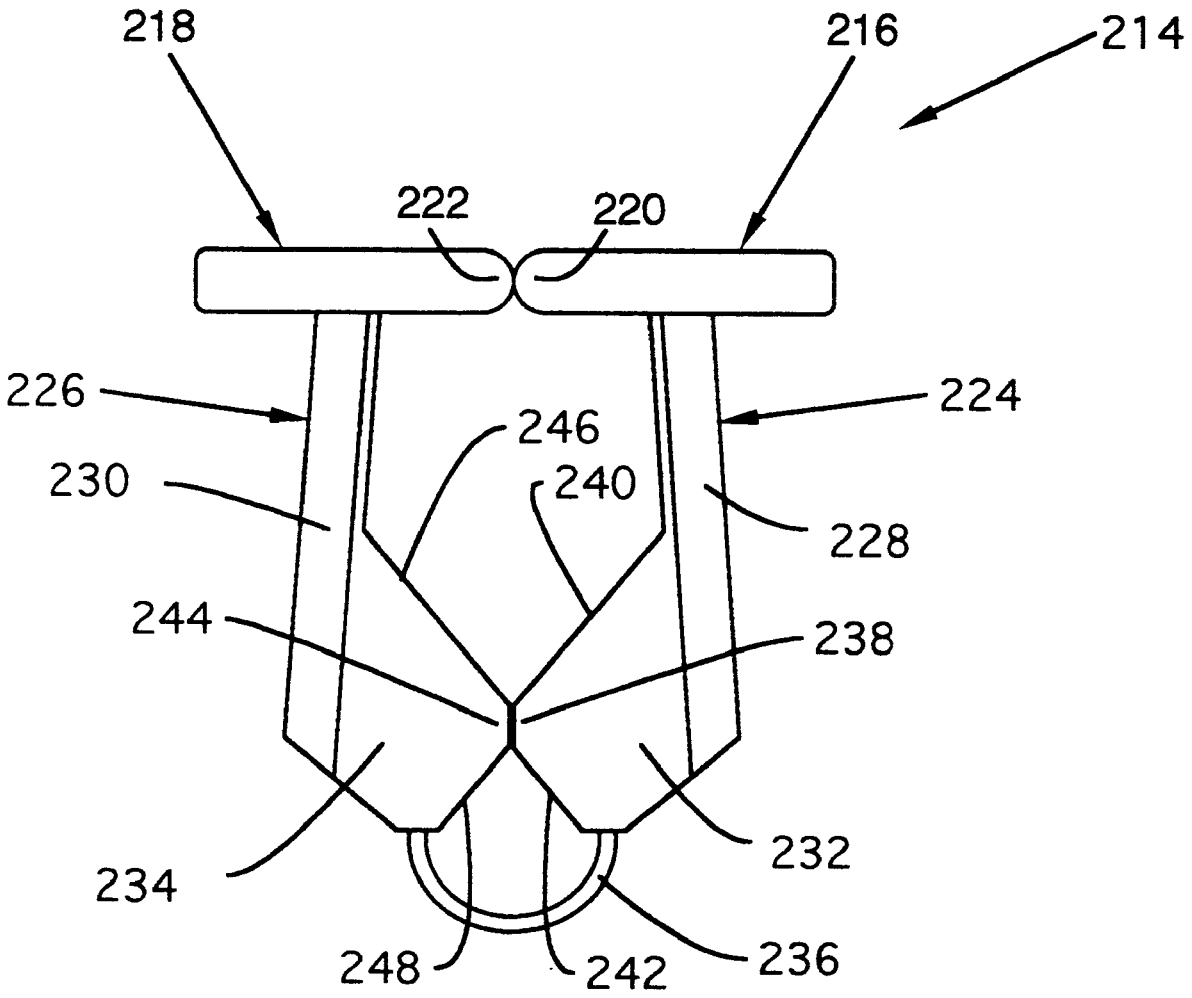
FIG. 27 illustrates a front view of a flexible flanged cap for use at the top or bottom end of a tubular leg having tapered ends.

FIG. 27 illustrates a front view of a flexible flanged cap 214 for use at the top or bottom end of a tubular leg. The flexible flanged cap 214 is constructed much in the same manner and includes component members similar in design and function as the flexible flanged connector 120, including opposing semi-circular flanges 216 and 218 having inwardly facing edges 220 and 222 each of semi-circular cross section, opposing cams 224 and 226 and including outward facing truncated curved surfaces 228 and 230, cam nodes 232 and 234 at the ends of the truncated curved surfaces 228 and 230, and a flexible living hinge 236. Included on the cam node 232 are a vertically aligned surface 238, an upper angled surface 240 intersecting the vertically aligned surface 238, and a lower angled surface 242 intersecting the vertically aligned surface 238. Included on the cam node 234 are a vertically aligned surface 244, an upper angled surface 246 intersecting the vertically aligned surface 244, and a lower angled surface 248 intersecting the vertically aligned surface 244. The flexible flanged cap 214 is distorted for insertion into the end of a tubular leg and then brought into alignment as shown by depressing both semi-circular flanges 216 and 218 appropriately until the inwardly facing edges 220 and 222 are in direct oppositional engagement. The cam nodes 232 and 234 are also brought into direct opposition and engagement to fulfill the wedge-to-taper relationship with the top of a tapered tube, as previously described.

FIG. 28, a fifth alternate embodiment, illustrates a cross sectional view of one end of a shelf assembly system 250 incorporating the flexible flanged connector 120, where all numerals correspond to those elements previously or otherwise described. An upper, a middle and a lower planar shelf board 252, 254 and 256 are connected together by use of flexible flanged connectors 120 and by a flexible flanged cap 214. A bottom cap 258 is shown in a shortened tapered tubular leg 260. Although tapered bores 200 are illustrated, a plain bore 262 could be used in conjunction with a split female connector 18. The use of the split female connector 18 would allow a plain and relatively easy to make bore 262, as shown in FIG. 29, to be incorporated in the planar shelves 252, 254 and 256.

Figure 29:
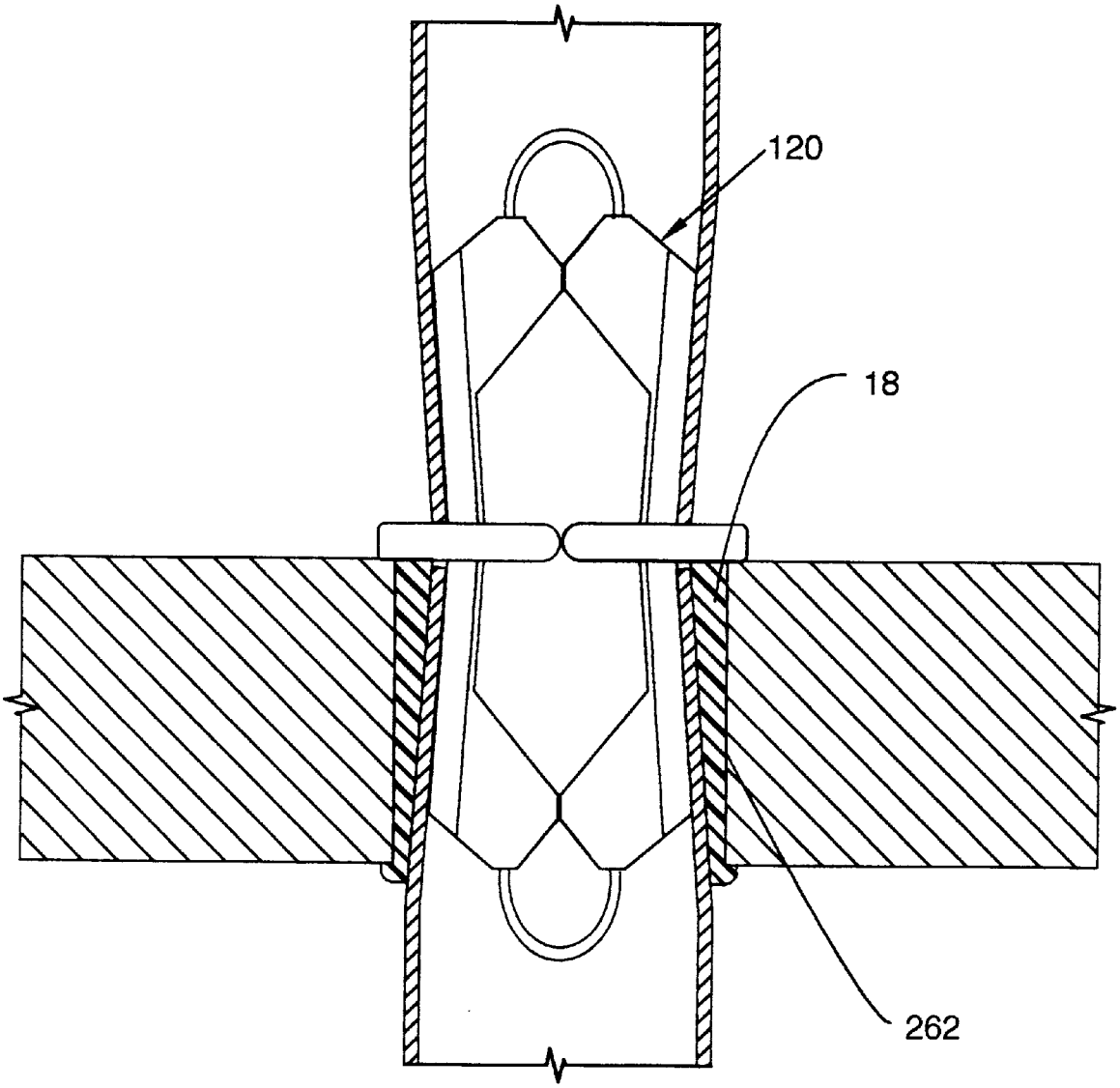

FIG. 29 illustrates a cross sectional view of a modified shelf board and tubular leg connecting arrangement incorporating the flexible flanged connector 120 and a split female connector 18 engaging a plain bore 262 in a planar shelf board, where all numerals correspond to those elements previously or otherwise described.

Various modifications can be made to the present invention without departing from the apparent scope hereof.

SHELF ASSEMBLY SYSTEM
PARTS LIST

| | |
|---|---|
| 10 | shelf assembly system |
| 11 | leg assembly |
| 12 | leg |
| 13 | planar shelf board |
| 14 | connector assembly |
| 15 | planar shelf board |
| 17 | flanged tubular insert |
| 17a | cylindrical tube |
| 17b | bore |
| 17c | flange |
| 18 | split female connector |
| 19 | glide |
| 19a | shaft |
| 19b | disc |
| 19c | plastic member |
| 20 | split male connector |
| 21 | cap |
| 22 | wall |
| 23 | planar shelf board |
| 24 | outer cylindrical surface |
| 25 | leg assembly |
| 26 | inner tapered surface |
| 28 | annular lip |
| 30 | slit |
| 31 | annular surface |
| 32 | wall |
| 34 | outer tapered surface |
| 36 | inner cylindrical surface |
| 38 | annular lip |
| 40 | slit |
| 42 | annular surface |
| 44 | bore |
| 48 | planar surface |
| 52 | bore |
| 60 | shelf assembly system |
| 62 | flanged double male connector |
| 64 | cylindrical member |
| 64a | upper cylindrical portion |
| 64b | lower cylindrical portion |
| 66 | flange |
| 67 | planar surface |
| 68 | recess |
| 69 | planar surface |
| 70 | annular surface |
| 72 | leg |
| 74 | bore |
| 76 | shelved caddy |
| 78 | casters |
| 80 | glide leg assembly |
| 82 | threaded stabilizer rod assembly |
| 84 | threaded rod |
| 86 | split flanged tubular insert |
| 86a | flanged tubular insert half |
| 86b | flanged tubular insert half |
| 87a-b | semicircular flanges |

-continued

| SHELF ASSEMBLY SYSTEM PARTS LIST | |
|---|---|
| 88 | nut |
| 90 | recessed cap |
| 90a | disk portion |
| 91 | internal bore |
| 92 | cap nut |
| 94 | recess |
| 96 | shoulder |
| 98 | bore |
| 100 | threaded surface |
| 102 | molded interior capture surface |
| 104 | planar surface |
| 106 | planar surface |
| 108 | shaft |
| 109 | leg |
| 110 | shaft |
| 112 | wire shelving |
| 114 | tube |
| 116 | thick planar shelf board |
| 118 | bore |
| 120 | flexible flanged connector |
| 122 | right structure |
| 124 | left structure |
| 126 | semi-circular flange |
| 128 | outwardly facing circumferential edge |
| 130 | inwardly facing edge |
| 132 | upper planar surface |
| 134 | lower planar surface |
| 136 | upper cam |
| 138 | lower cam |
| 140 | truncated curved surface |
| 142 | cam node |
| 143 | truncated curved surface |
| 144 | truncated curved surface |
| 145 | truncated curved surface |
| 146 | cam node |
| 148 | semi-circular flange |
| 150 | outwardly facing circumferential edge |
| 152 | inwardly facing edge |
| 154 | upper planar surface |
| 156 | lower planar surface |
| 158 | upper cam |
| 160 | cam node |
| 162 | lower cam |
| 164 | cam node |
| 166 | flexible living hinge |
| 168 | flexible living hinge |
| 170 | vertically aligned surface |
| 172 | upper angled surface |
| 174 | lower angled surface |
| 176 | vertically aligned surface |
| 178 | upper angled surface |
| 180 | lower angled surface |
| 182 | vertically aligned surface |
| 184 | upper angled surface |
| 186 | lower angled surface |
| 188 | vertically aligned surface |
| 190 | upper angled surface |
| 192 | lower angled surface |
| 194 | upper tubular leg |
| 196 | lower tubular leg |
| 198 | planar shelf board |
| 200 | tapered bore |
| 202 | bottom planar surface |
| 204 | top planar surface |
| 206 | tapered end |
| 207 | annular tip |
| 208 | orifice |
| 210 | tapered end |
| 211 | orifice |
| 212 | lower tip |
| 214 | flexible flanged cap |
| 216 | semi-circular flange |
| 218 | semi-circular flange |
| 220 | inwardly facing edge |
| 222 | inwardly facing edge |
| 224 | cam |

-continued

| SHELF ASSEMBLY SYSTEM PARTS LIST | |
|---|---|
| 226 | cam |
| 228 | truncated curved surface |
| 230 | truncated curved surface |
| 232 | cam node |
| 234 | cam node |
| 236 | flexible living hinge |
| 238 | vertically aligned surface |
| 240 | upper angled surface |
| 242 | lower angled surface |
| 244 | vertically aligned surface |
| 246 | upper angled surface |
| 248 | lower angled surface |
| 250 | shelf assembly system |
| 252 | upper planar shelf board |
| 254 | middle planar shelf board |
| 256 | lower planar shelf board |
| 258 | bottom cap |
| 260 | shortened tapered tubular leg |
| 262 | plain bore |

What is claimed is:

1. A one-piece flexible connector for fastening two circular tubular legs having tapered ends to each other and to a shelf board in a shelf assembly system, comprising: left and right elongated structures; each of said left and right elongated structures including a centrally located horizontally oriented flange having upper and lower surfaces, an upper cam member joined to said upper surface of said flange, extending upwardly and outwardly from said upper surface of said flange, and terminating in a free end, and a lower cam member joined to said lower surface of said flange, extending downwardly and outwardly from said lower surface of said flange, and terminating in a free end; a first flexible living hinge connecting the free ends of the upper cam members; and a second flexible living hinge connecting the free ends of the lower cam members.

2. The one-piece flexible connector according to claim 1, wherein said left and right elongated structures are mirror images of each other.

3. The one-piece flexible connector according to claim 1, wherein each of said upper cam members includes an outwardly facing curved surface which extends from the upper surface of the respective flange to which it is joined to its free end, and wherein each of said lower cam members includes an outwardly facing curved surface which extends from the lower surface of the respective flange to which it is joined to its free end.

4. The one-piece flexible connector according to claim 3, wherein each of said upper and lower cam members further includes an inwardly facing cam node at its free end.

5. The one-piece flexible connector according to claim 4, wherein each of the inwardly facing cam nodes at the free ends of said upper cam members includes an inwardly facing upper surface which begins at the free end of the respective cam member and angles inwardly and downwardly to an inwardly facing vertical surface, and an inwardly facing lower surface which angles outwardly and downwardly from said inwardly facing vertical surface; and wherein each of the inwardly facing cam nodes at the free ends of said lower cam members includes an inwardly facing lower surface which begins at the free end of the respective cam member and angles inwardly and upwardly to an inwardly facing vertical surface, and an inwardly facing upper surface which angles outwardly and upwardly from said inwardly facing vertical surface.

6. The one-piece flexible connector according to claim 5, wherein each of said flanges is semi-circular in configuration, and wherein the diametric edges of said semi-circular flanges face each other.

7. The one-piece flexible connector according to claim 6, wherein said left and right elongated structures are mirror images of each other.

8. A one-piece flexible cap for fastening a circular tubular leg having a tapered end to a shelf board in a shelf assembly system, comprising:

a. left and right elongated structures; each of said left and right elongated structures including a horizontally oriented flange having upper and lower surfaces and a cam member joined to said lower surface of said flange, extending downwardly and outwardly from said lower surface of said flange, and terminating in a free end; and a flexible living hinge connecting said free ends of said cam members;

b. the one-piece flexible cap, wherein said left and right elongated structures are mirror images of each other;

c. wherein each of said cam members includes an outwardly facing curved surface which extends from the lower surface of the respective flange to which it is joined to its free end;

d. wherein each of said cam members further includes an inwardly facing cam nod at its free end; and, e. wherein each of said inwardly facing nodes includes an inwardly facing lower surface which begin, at the free end of the respective cam member and angles inwardly and upwardly to an inwardly facing vertical surface, and an inwardly facing upper surface which angles outwardly, and upwardly from said inwardly facing vertical surface.

9. The one-piece flexible cap according to claim 8, wherein each of said flanges is semi-circular in configuration, and wherein the diametric edges of said semi-circular flanges face each other.

10. The one-piece flexible cap according to claim 9, wherein said left and right elongated structures are mirror images of each other.

11. A leg to shelf connection for a shelf assembly system, comprising:

a. a shelf board having a top side, a bottom side, and a tapered bore extending therethrough from said top side to said bottom side, said tapered bore tapering from a large end at said bottom side to a small end at said top side;

b. a circular tubular leg having a tapered end which matches the taper of said tapered bore in said shelf board, said tapered end of said circular tubular leg being inserted into said tapered bore in said shelf board from the large end of said tapered bore;

c. a one-piece flexible cap locking said tapered end of said circular tubular leg within said tapered bore in said shelf board; and, d. wherein said one-piece flexible cap comprises left and right elongated structures each of said left and right elongated structures including a horizontally oriented flange having upper and lower surfaces and a cam member joined to said lower surface of said flange, extending downwardly and outwardly from said lower surface of said flange, and terminating in a free end; said lower surface of said flanges bearing against said top side of said shelf board, and said cam members residing within said tapered end of said circular tubular leg; and a flexible living hinge connecting the free ends of said cam members.

12. The leg to shelf connection according to claim 11, wherein each of said cam members includes an outwardly facing curved surface which extends from the lower surface of the respective flange to which it is joined to its free end; each said outwardly facing curved surface matching the curvature of the interior surface of the tapered end of said circular tubular leg and bearing against the interior surface of the tapered end of said circular tubular leg.

13. The leg to shelf connection according to claim 12, wherein each of said cam members further includes an inwardly facing cam node at its free end, said cam nodes bearing against each other to maintain said outwardly facing curved surfaces against the interior surface of the tapered end of said circular tubular leg.

14. The leg to shelf connection according to claim 13, wherein each of said flanges is semi-circular in configuration, and wherein the diametric edges of said semi-circular flanges abut each other.

15. The leg to shelf connection according to claim 14, wherein said left and right elongated structures are mirror images of each other.

16. The leg to shelf connection according to claim 11, wherein said tapered bore extending through said shelf board is formed by a right circular cylindrical hole through said shelf board lined with a tubular sleeve having a right circular cylindrical outer surface and a conical inner surface.

17. A leg to shelf connection for a shelf assembly system, comprising;

a. a shelf board having a top side, a bottom side and a tapered bore extending therethrough from said top side to said bottom side, said tapered bore tapering from a large end at said bottom side to a small end at said top side;

b. a first circular tubular leg having a tapered end which matches the taper of said tapered bore in said shelf board, said tapered end of said first circular tubular leg being inserted into said tapered bore in said shelf board from the large end of said tapered bore;

c. a second circular tubular leg having a tapered end, said second circular tubular leg being located above the top side of said shelf board in vertical alignment with said first circular tubular leg;

d. a one-piece flexible connector locking said tapered end of said first circular tubular leg within said tapered bore in said shelf board and securing said second circular tubular leg to said shelf board and to said first circular tubular leg; and e. wherein said one-niece flexible connector comprises left and right elongated structures; each of said left and right elongated structures including a centrally located horizontally oriented flange having upper and lower surfaces, an upper cam member joined to said upper surface of said flange, extending upwardly and outwardly from said upper surface of said flange, and terminating in a free end, and a lower cam member joined to said lower surface of said flange, extending downwardly and outwardly from said lower surface of said flange, and terminating in a free end; said lower surfaces of said flanges bearing against said top side of said shelf board; said lower cam members residing within said tapered end of said first circular tubular leg; said tampered end of said second tubular leg bearing against said upper surfaces of said flanges; said upper member residing within said tapered end of said second circular tubular leg; a first flexible living hinge connecting the free ends of the upper cam members; and a second flexible living hinge connecting the free ends of the lower cam members.

18. The leg to shelf connection according to claim 17, wherein each of said lower cam members includes an outwardly facing curved surface which extends from the lower surface of the respective flange to which it is joined to its free end, each said lower cam member outwardly facing curved surface matching the curvature of the interior surface of the tapered end of said first circular tubular leg and bearing against the interior surface of the tapered end of said first circular tubular leg; and wherein each of said upper cam members includes an outwardly facing curved surface which extends from the upper surface of the respective flange to which it is joined to its free end, each said upper cam member outwardly facing curved surface matching the curvature of the interior surface of the tapered end of said second circular tubular leg and bearing against the interior surface of the tapered end of said second circular tubular leg.

19. The leg to shelf connection according to claim 18, wherein each of said lower cam members further includes an inwardly facing cam node at its free end, said cam nodes of said lower cam members bearing against each other to maintain said lower cam member outwardly facing curved surfaces against the interior surface of the tapered end of said first circular tubular leg; and wherein each of said upper cam members further includes an inwardly facing cam node at its free end, said cam nodes of said upper cam members bearing against each other to maintain said upper cam member outwardly facing curved surfaces against the interior surface of the tapered end of said second circular tubular leg.

20. The leg to shelf connection according to claim 19, wherein each of said flanges is semi-circular in configuration, and wherein the diametric edges of said semi-circular flanges abut each other.

21. The leg to shelf connection according to claim 20, wherein said left and right elongated structures are mirror images of each other.

22. The leg to shelf connection according to claim 17, wherein said tapered bore extending through said shelf board is formed by a right circular cylindrical hole through said shelf board lined with a tubular sleeve having a right circular cylindrical outer surface and a conical inner surface.

23. A shelf assembly system, comprising:

a. a plurality of shelf boards, including at least a bottom shelf board and an uppermost shelf board, positioned in spaced relationship each above another, each shelf board having a top side and a bottom side;

b. a plurality of tapered bores extending through each shelf board from the top side to the bottom side, each tapered bore tapering from a large end at the bottom side to a small end at the top side, said tapered bores being equal in number in each shelf board and positioned at corresponding locations in each shelf board, and the correspondingly located tapered bores in each shelf board being in direct vertical alignment with one another from the bottom shelf board to the uppermost shelf board;

c. a plurality of circular tubular legs equal in number to the total number of tapered bores in all of the shelf boards, each of said circular tubular legs having at least a first tapered end inserted into a tapered bore from the large end of the tapered bore, and all of the circular tubular legs which are located between adjacent shelf boards having a second tapered end located above the small end of a tapered bore in alignment therewith;

d. a plurality of one-piece flexible caps equal in number to the number of tapered bores in said uppermost shelf board, each of said one-piece flexible caps locking a tapered end of a circular tubular leg within a tapered bore of said uppermost shelf board;

e. a plurality of one-piece flexible connectors equal in number to the total number of tapered bores in all of the shelf boards except said uppermost shelf board, each of said one-piece flexible connectors fastening tapered ends of two circular tubular legs to each other and to a shelf board at a tapered bore;

f. each of said one-piece flexible caps comprises left and right elongated structures connected together by a flexible living hinge, each of said left and right elongated structure including a horizontally oriented flange having upper and lower surfaces and a cam member extending downwardly and outwardly from said lower surface of said flange, said lower surfaces of said flanges bearing against the top side of said uppermost shelf board above a tapered bore, and said cam members residing within the tapered end of the circular tubular leg located within that tapered bore; and, g. each of said one-piece flexible connectors comprises left and right elongated structures connected together by living hinges, each of said left and right elongated structures including a centrally located horizontally oriented flange having upper and lower surfaces, an upper can member joined to said upper surface of said flange and extending upwardly and outwardly from said upper surface of said flange, and a lower cam member joined to said lower surface of said flange and extending downwardly and outwardly from said lower surface of said flange, said lower surfaces of said flanges bearing against the top side of a shelf board above a tapered bore, said upper cam members residing within the tapered end of the circular tubular leg located above that tapered bore, and said lower cam members residing within the tapered end of the circular tubular leg located within that tapered bore.

* * * * *